US011745977B2

(12) United States Patent
Minoshima et al.

(10) Patent No.: US 11,745,977 B2
(45) Date of Patent: Sep. 5, 2023

(54) SHEET CONVEYANCE DEVICE AND IMAGE FORMING DEVICE

(71) Applicant: BROTHER KOGYO KABUSHIKI KAISHA, Nagoya (JP)

(72) Inventors: Saya Minoshima, Gifu (JP); Yasuhiro Suzuki, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 104 days.

(21) Appl. No.: 17/173,328

(22) Filed: Feb. 11, 2021

(65) Prior Publication Data

US 2021/0253383 A1 Aug. 19, 2021

(30) Foreign Application Priority Data

Feb. 14, 2020 (JP) ..... 2020-023371
Feb. 14, 2020 (JP) ..... 2020-023372

(51) Int. Cl.
*B65H 85/00* (2006.01)
*B65H 3/06* (2006.01)
*B65H 5/06* (2006.01)

(52) U.S. Cl.
CPC ..... *B65H 85/00* (2013.01); *B65H 3/0669* (2013.01); *B65H 5/06* (2013.01); *B65H 2301/33312* (2013.01); *B65H 2403/48* (2013.01); *B65H 2403/81* (2013.01); *B65H 2403/942* (2013.01)

(58) Field of Classification Search
CPC ..... B65H 3/0669; B65H 5/06; B65H 5/062; B65H 85/00; B65H 2301/3331; B65H 2301/33312; B65H 2403/21; B65H 2403/80; B65H 2403/81; B65H 2403/942
See application file for complete search history.

(56) References Cited

U.S. PATENT DOCUMENTS

2006/0290049 A1* 12/2006 Fujiwara ..... B65H 15/00 271/225
2011/0156336 A1* 6/2011 Agata ..... B65H 5/062 271/3.19
2013/0020753 A1* 1/2013 Ito ..... B65H 85/00 271/225
2014/0291923 A1* 10/2014 Hashimoto ..... B65H 5/062 271/225
2014/0294476 A1 10/2014 Hashimoto et al.
2016/0289036 A1* 10/2016 Kosaka ..... B65H 85/00

FOREIGN PATENT DOCUMENTS

JP 2014-199368 A 10/2014
JP 2015-038555 A 2/2015
JP 2015-107871 A 6/2015

* cited by examiner

*Primary Examiner* — Prasad V Gokhale
(74) *Attorney, Agent, or Firm* — Merchant & Gould P.C.

(57) ABSTRACT

A sheet conveyance device includes: a first conveyance path configured to allow a sheet to be conveyed along the first conveyance path; a second conveyance path that extends upward from a branch position in the first conveyance path; a third conveyance path that extends downward from the branch position; a first conveyance roller disposed in the second conveyance path and configured to rotate normally and reversely to convey the sheet; a first drive motor disposed below the branch position; and a first belt disposed in a drive transmission path from the first drive motor to the first conveyance roller and configured to transmit a driving force from the first drive motor to the first conveyance roller.

20 Claims, 16 Drawing Sheets

SHEET CONVEYANCE DEVICE AND IMAGE FORMING DEVICE

CROSS-REFERENCE TO RELATED APPLICATION

This application claims priority from Japanese Patent Application No. 2020-023371 filed on Feb. 14, 2020 and Japanese Patent Application No. 2020-023372 filed on Feb. 14, 2020, the contents of which are incorporated herein by reference in their entireties.

TECHNICAL FIELD

The present disclosure relates to a sheet conveyance device and an image forming device including the same.

BACKGROUND

A related art discloses an image forming device such as a laser printer that includes a discharge roller capable of rotating normally and reversely to switch back a sheet for duplex printing. For example, JP-A-2014-199368 discloses an image forming device in which a drive transmission path from a drive motor to a discharge roller is constituted by a plurality of gears.

According to the configuration in which the drive motor and the discharge roller are connected by the gears as in JP-A-2014-199368, it is difficult to prevent noise no matter where the drive motor is disposed. For example, when the drive motor is disposed in a lower portion of the image forming device, a distance from the drive motor to the discharge roller becomes large and the number of gears increases, so that the noise that occurs due to meshing of the gears becomes large.

In addition, when the drive motor is disposed in an upper portion of the image forming device, the distance from the drive motor to the discharge roller becomes short, so that the number of gears can be reduced. However, the distance from the drive motor to a discharge port located downstream of the discharge roller also becomes short, so that sound easily leaks from the discharge port. Such a situation is the same as long as a sheet conveyance device is configured to switch back a sheet by a conveyance roller capable of rotating normally and reversely.

SUMMARY

An object of the present disclosure is to provide a sheet conveyance device capable of reducing noise even when a distance from a drive motor to a conveyance roller is long. Another object of the present disclosure is to provide an image forming device including the sheet conveyance device.

An aspect of the present disclosure is a sheet conveyance device including:

a first conveyance path configured to allow a sheet to be conveyed along the first conveyance path;

a second conveyance path that extends upward from a branch position in the first conveyance path, the second conveyance path being configured to allow the sheet that has passed through the first conveyance path to be conveyed along the second conveyance path;

a third conveyance path that extends downward from the branch position, the third conveyance path being configured to allow the sheet that has passed through the second conveyance path to be conveyed along the third conveyance path;

a first conveyance roller disposed in the second conveyance path and configured to rotate normally and reversely to convey the sheet;

a first drive motor disposed below the branch position; and a first belt disposed in a drive transmission path from the first drive motor to the first conveyance roller and configured to transmit a driving force from the first drive motor to the first conveyance roller.

According to the above configuration, even in a configuration in which the first conveyance roller and the first drive motor are disposed in an upper-lower direction with the branch position being located therebetween so that a transmission distance of driving becomes large, noise can be reduced by using the first belt as means for transmitting the driving force from the first drive motor. In addition, the sheet can be switched back in the second conveyance path by providing the first conveyance roller capable of rotating normally and reversely.

BRIEF DESCRIPTION OF DRAWINGS

The above and other aspects of the present disclosure will become more apparent and more readily appreciated from the following description of illustrative embodiments of the present disclosure taken in conjunction with the attached drawings, in which.

DETAILED DESCRIPTION

Figure 1:
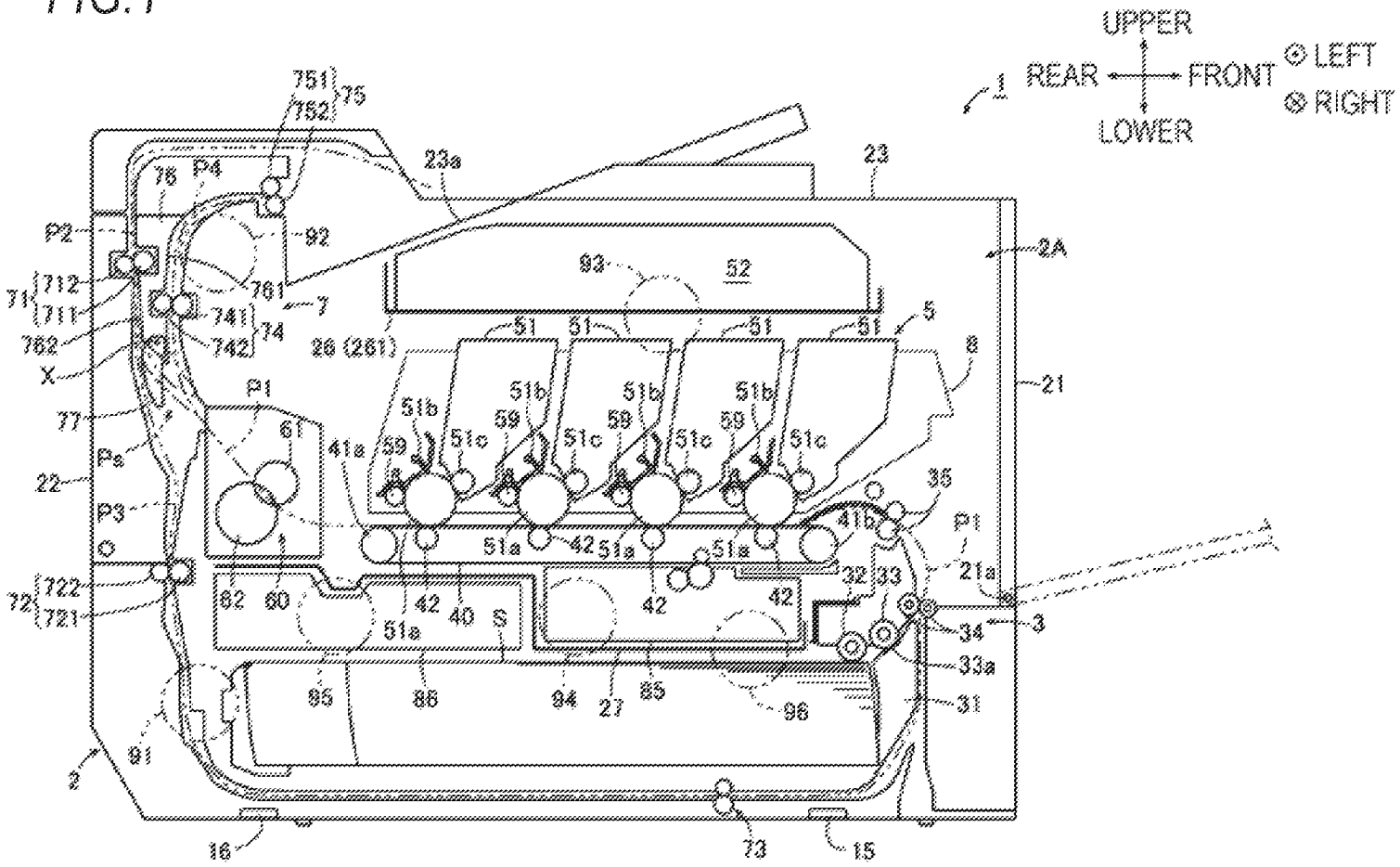
FIG. 1 is a central cross-sectional view of an image forming device according to an embodiment of the present disclosure.

An image forming device 1 shown in FIG. 1 is an embodiment of an image forming device according to the present disclosure, and is a color laser printer that forms an image in a plurality of colors on a sheet S by an electrophotographic method. However, the image forming device 1 may be a monochrome laser printer that forms a monochrome image on the sheet S.

In the following description, a right side in FIG. 1 is defined as a front side of the image forming device 1, a left side in FIG. 1 is defined as a rear side of the image forming device 1, a front side of a paper surface in FIG. 1 is defined as a left side of the image forming device 1, and a back side of the paper surface in FIG. 1 is defined as a right side of the image forming device 1. In addition, an upper side and a lower side in FIG. 1 are defined as an upper side and a lower side of the image forming device 1, respectively. An upward direction is one component in an upper-lower direction, and a downward direction is also one component in the upper-lower direction. Similarly, a forward direction and a rearward direction are each a component in a front-rear direction. A leftward direction and a rightward direction are each a component in a left-right direction.

The image forming device 1 includes a main body 2, a sheet feeding unit 3 that feeds the sheet S, an image forming unit 5 that forms the image on the sheet S, and a sheet conveyance unit 7 that conveys the sheet S on which the image is formed by the image forming unit 5.

The main body 2 is a box body formed in a substantially rectangular parallelepiped shape, and accommodates the sheet feeding unit 3, the image forming unit 5 and the sheet conveyance unit 7.

The main body 2 has an opening 2A and a front cover 21 capable of opening and closing the opening 2A. The opening 2A and the front cover 21 are provided on a front surface. The front cover 21 is pivotable about a pivot axis 21*a* at a lower end thereof. The front cover 21 is movable between a closed position (a position shown by a solid line in FIG. 1) where the opening 2A is closed and an open position (a position shown by a two-dot chain line in FIG. 1) where the opening 2A is opened by pivoting about the pivot axis 21*a*. By moving the front cover 21 to the open position to open the opening 2A, a drawer 8 described later can be pulled out from the main body 2 through the opening 2A, and can be attached to the main body 2.

A left surface, a right surface and a rear surface of the main body 2 are covered with side surface covers 22 constituting an appearance of the image forming device 1. An upper portion of the main body 2 is covered with an upper surface cover 23. A discharge tray 23*a* that is recessed so as to be inclined downward from a front side toward a rear side is formed in the upper surface cover 23.

The sheet feeding unit 3 includes a sheet cassette 31, a sheet feeding roller 32, a separation roller 33, a separation pad 33*a*, a conveyance roller pair 34 and a resist roller pair 35. A conveyance path P1 along which the sheet S passes from the sheet cassette 31 through the image forming unit 5 is formed in the main body 2. The sheet feeding roller 32, the separation roller 33, the separation pad 33*a*, the conveyance roller pair 34 and the resist roller pair 35 constitute a conveyance unit that conveys a sheet.

The sheet cassette 31 supports a plurality of sheets S in a stacked state. The sheets S supported by the sheet cassette 31 are fed one by one to the conveyance path P1 by the sheet feeding roller 32, the separation roller 33 and the separation pad 33*a*. The sheet S fed to the conveyance path P1 is conveyed toward the image forming unit 5 by the conveyance roller pair 34 and the resist roller pair 35.

The image forming unit 5 is disposed above the sheet feeding unit 3, and includes four drum units 51 arranged side by side in the front-rear direction. The respective drum units 51 are provided corresponding to respective colors of black, yellow, magenta and cyan. Each drum unit 51 includes a photosensitive drum 51*a*, a charger 51*b*, a developing roller 51*c* and a drum cleaning roller 59.

The image forming device 1 includes the drawer 8 that supports the drum units 51. The drawer 8 is detachably attached to the main body 2. The photosensitive drum 51*a* included in the drum unit 51 is supported in a state where a position thereof is fixed to the drawer 8. The developing roller 51*c* is supported by the drawer 8 so as to be movable between a position where the developing roller 51*c* is in contact with the photosensitive drum 51*a* and a position where the developing roller 51*c* is separated from the photosensitive drum 51*a*.

The image forming unit 5 includes a scanner unit 52 and a fixing unit 60. The scanner unit 52 is provided in an upper portion of the main body 2, and laser light based on image data is emitted by high-speed scanning onto a surface of the photosensitive drum 51*a* corresponding to each color through a polygon mirror, a lens, a reflector and the like. The fixing unit 60 is disposed further downstream than the photosensitive drum 51*a* located the most downstream in a conveyance direction of the sheet S.

A transfer belt 40 is disposed below the image forming unit 5 to sandwich the conveyance path P1 with the image forming unit 5. The transfer belt 40 is hung on a drive roller 41*a* and a driven roller 41*b* disposed in front of the drive roller 41*a*. Transfer rollers 42 are respectively disposed at positions facing the photosensitive drums 51*a* sandwiching the transfer belt 40.

In the image forming unit 5, the photosensitive drum 51*a* uniformly charged by the charger 51*b* is selectively exposed by the scanner unit 52. By this exposure, charges are selectively removed from a surface of the photosensitive drum 51*a*, and an electrostatic latent image is formed on the surface of the photosensitive drum 51*a*.

A developing bias is applied to the developing roller 51*c*, and when the electrostatic latent image formed on the photosensitive drum 51*a* faces the developing roller 51*c*, a toner is supplied to the electrostatic latent image of the photosensitive drum 51*a* from the developing roller 51*c* due to a potential difference between the electrostatic latent image and the developing roller 51*c*. Thereby, a toner image is formed on the surface of the photosensitive drum 51*a*.

When the sheet S that has been conveyed toward the image forming unit 5 is conveyed onto the transfer belt 40, the sheet S is conveyed by the transfer belt 40 and sequentially passes between the transfer belt 40 and the photosensitive drums 51*a*. When the toner image on the surface of the photosensitive drum 51*a* faces the sheet S, the toner image is transferred to the sheet S by a transfer bias applied to the transfer roller 42.

At this time, the toner that has not been transferred to the sheet S may remain on the surface of the photosensitive drum 51*a*. The waste toner remaining on the surface of the photosensitive drum 51*a* is electrically held on a surface of the drum cleaning roller 59 by a drum cleaning bias as the photosensitive drum 51*a* rotates.

The sheet S to which the toner image has been transferred is conveyed to the fixing unit 60. The fixing unit 60 includes a heating roller 61 that heats the sheet S and a pressing roller 62 that is disposed to face the heating roller 61. The sheet S that has been conveyed to the fixing unit 60 passes between the heating roller 61 and the pressing roller 62 that are in pressure contact with each other, so that the toner image is thermally fixed. In this way, the fixing unit 60 is a unit that fixes the toner image formed on the sheet S.

A power supply unit 86 is provided below the fixing unit 60 and above the sheet cassette 31 in the main body 2, and the heating roller 61 is heated by electric power supplied from the power supply unit 86.

The sheet S on which the toner image has been thermally fixed is conveyed from the image forming unit 5 downstream in the conveyance direction by the sheet conveyance unit 7. The sheet S that has been conveyed by the sheet conveyance unit 7 is discharged to the discharge tray 23*a*, or is conveyed again toward the image forming unit 5 along a conveyance path P3 constituting a re-conveyance path described later.

A belt cleaner unit 85 that collects the waste toner adhering to the transfer belt 40 is provided below the transfer belt 40 and above the sheet cassette 31 in the main body 2. The belt cleaner unit 85 is located in front of the power supply unit 86. The waste toner held on the drum cleaning roller 59 is collected by the belt cleaner unit 85 via the photosensitive drum 51*a* and the transfer belt 40 in a cleaning operation performed when image formation by the image forming unit 5 is completed.

The sheet conveyance unit 7 includes the conveyance path P1, a conveyance path P2, the conveyance path P3 and a conveyance path P4. The conveyance path P1 is a path along which the sheet S on which an image has been formed by the image forming unit 5 is conveyed from the image forming unit 5 downstream in the conveyance direction. The conveyance path P1 obliquely extends rearward and upward from the fixing unit 60. The conveyance path P2 is a path extending upward from a branch position Ps in the conveyance path P1 and along which the sheet S that has passed through the conveyance path P1 is conveyed. The conveyance path P3 is a path extending downward from the branch position Ps and along which the sheet S that has passed through the conveyance path P2 is conveyed. The conveyance path P4 is a path extending upward from the branch position Ps and along which the sheet S that has passed through the conveyance path P1 is conveyed.

The conveyance path P2 and the conveyance path P3 constitute the re-conveyance path for conveying the sheet S that has been conveyed downstream in the conveyance direction from the image forming unit 5 toward the image forming unit 5 again. In the image forming device 1, for example, when duplex printing is performed on the sheet S, the sheet S that has been conveyed downstream in the conveyance direction from the image forming unit 5 is conveyed again toward the image forming unit 5 along the conveyance path P2 and the conveyance path P3.

The conveyance path P2 is the path for switching back the sheet S that has been conveyed from the image forming unit 5 to switch front and back sides of the sheet S when the duplex printing is performed on the sheet S. The conveyance path P2 obliquely extends rearward and upward from the branch position Ps.

A switchback roller pair 71 is provided in the conveyance path P2. The switchback roller pair 71 is located above an intermediate discharge roller pair 74 described later. The switchback roller pair 71 includes a conveyance roller 711 capable of rotating normally and reversely, and a driven roller 712 driven to form a nip with the conveyance roller 711. The conveyance roller 711 is configured to be driven in a rotation direction (a normal rotation direction) when the sheet S is introduced into the conveyance path P2 and a rotation direction (a reverse rotation direction) when the sheet S is conveyed from the conveyance path P2 to the conveyance path P3.

The conveyance path P3 is the path branched from the branch position Ps and for conveying the sheet S that has been switched back toward the image forming unit 5 again. The conveyance path P3 extends downward from the branch position Ps, then bends forward, and further bends upward to join the conveyance path P1. The conveyance path P3 passes under the sheet cassette 31 in FIG. 1, but may be configured to pass over the sheet cassette 31. The sheet S that has been conveyed to the conveyance path P3 is conveyed toward the image forming unit 5 by an intermediate re-conveyance roller pair 72 and a re-conveyance roller pair 73 provided in the conveyance path P3.

The intermediate re-conveyance roller pair 72 is located at a portion of the conveyance path P3 that extends downward from the branch position Ps. The intermediate re-conveyance roller pair 72 is located below the branch position Ps. The re-conveyance roller pair 73 is located at a portion of the conveyance path P3 that extends in the front-rear direction. The intermediate re-conveyance roller pair 72 includes a conveyance roller 721 and a driven roller 722 driven to form a nip with the conveyance roller 721.

The conveyance path P4 is the path that guides the sheet S that has been conveyed along the conveyance path P1 toward the discharge tray 23*a*. The conveyance path P4 is also the path for switching back the sheet S that has been conveyed from the image forming unit 5 to switch the front and back sides of the sheet S when the duplex printing is performed on the sheet S. The conveyance path P4 extends upward from the branch position Ps and then forwardly extends toward the discharge tray 23*a*.

The intermediate discharge roller pair 74 and a discharge roller pair 75 are provided in the conveyance path P4. The discharge roller pair 75 is located downstream of the intermediate discharge roller pair 74 in the conveyance direction. The discharge roller pair 75 is located above the intermediate discharge roller pair 74 in the upper-lower direction. The intermediate discharge roller pair 74 is located below the switchback roller pair 71 in the upper-lower direction.

The intermediate discharge roller pair 74 includes a conveyance roller 741 capable of rotating normally and reversely, and a driven roller 742 driven to form a nip with the conveyance roller 741. The conveyance roller 741 is configured to be driven in a rotation direction (a normal rotation direction) when the sheet S is introduced into the conveyance path P4 and a rotation direction (a reverse rotation direction) when the sheet S is conveyed from the conveyance path P4 to the conveyance path P3.

The discharge roller pair 75 includes a conveyance roller 751 capable of rotating normally and reversely, and a driven roller 752 driven to form a nip with the conveyance roller 751. The conveyance roller 751 is configured to be driven in a rotation direction (a normal rotation direction) when the sheet S is introduced into the conveyance path P4 and a rotation direction (a reverse rotation direction) when the sheet S is conveyed from the conveyance path P4 to the conveyance path P3.

The sheet conveyance unit 7 includes a guide member 76. The guide member 76 has a first guide surface 761 constituting a part of the conveyance path P4 on a front surface and a second guide surface 762 constituting a part of the conveyance path P2 on a rear surface. The first guide surface 761 guides the sheet S conveyed along the conveyance path P4. The second guide surface 762 guides the sheet S conveyed along the conveyance path P2.

The sheet conveyance unit 7 includes a flapper 77. The flapper 77 is disposed at the branch position Ps. The flapper 77 is supported by the guide member 76 so as to be pivotable about a pivot axis X at an upper end portion thereof. The flapper 77 can switch the conveyance direction of the sheet S that has passed through the conveyance path P1 between the conveyance path P2 and the conveyance path P4 by pivoting about the pivot axis X. That is, the flapper 77 is configured to be switchable between a first position (a position shown by a solid line in FIG. 1) where the sheet S is guided from the conveyance path P1 to the conveyance path P4 and a second position (a position shown by a two-dot chain line in FIG. 1) where the sheet S is guided from the conveyance path P1 to the conveyance path P2.

The image forming device 1 includes a first drive motor 91, a second drive motor 92, a third drive motor 93, a fourth drive motor 94, a fifth drive motor 95 and a sixth drive motor 96. The first drive motor 91, the second drive motor 92, the third drive motor 93, the fourth drive motor 94, the fifth drive motor 95 and the sixth drive motor 96 are driven by the electric power supplied from the power supply unit 86.

Figure 2:
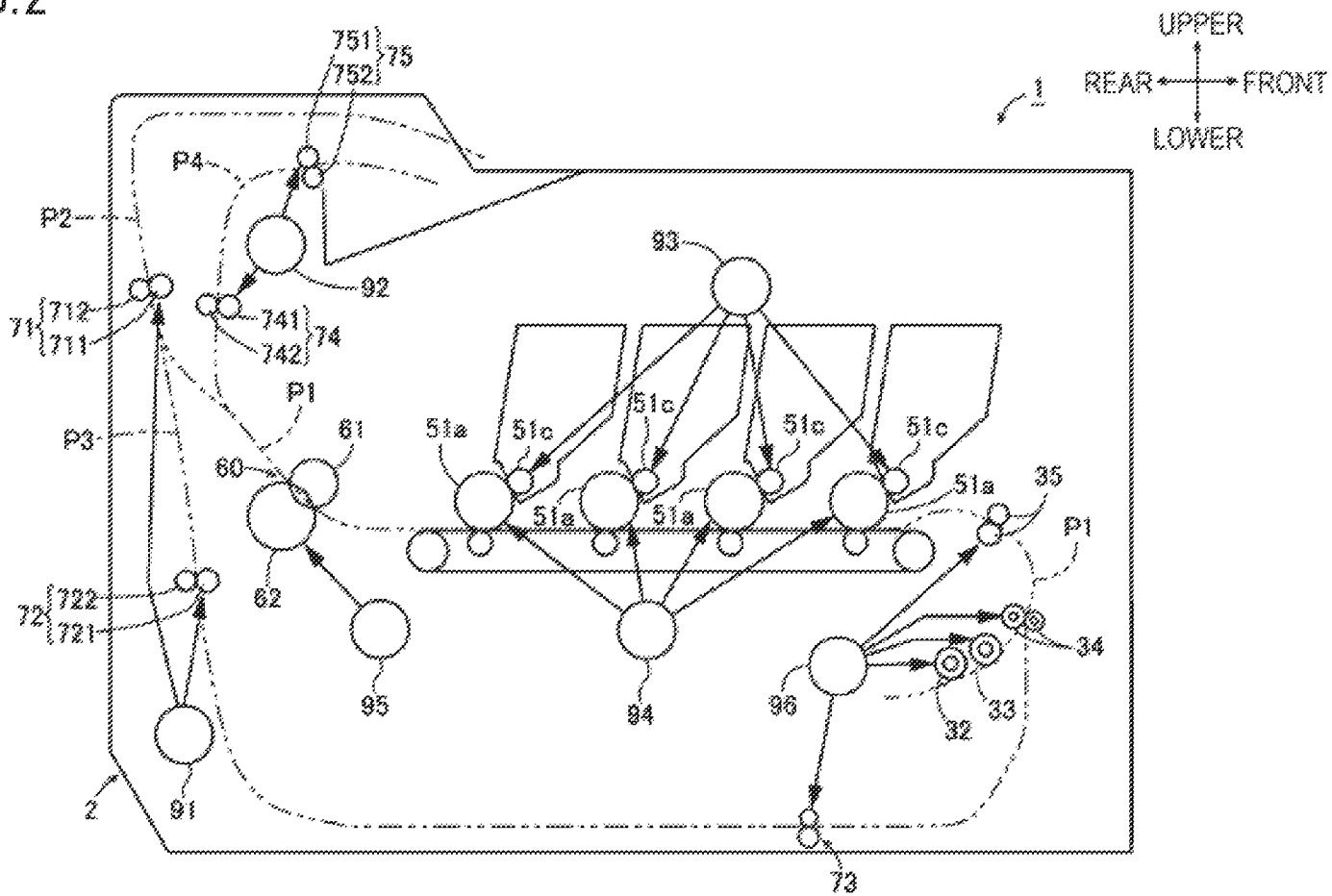
FIG. 2 is a schematic view showing drive destinations of drive motors.

As shown in FIG. 2, the first drive motor 91 drives the conveyance roller 711 and the conveyance roller 721. The second drive motor 92 drives the conveyance roller 751 and the conveyance roller 741.

The third drive motor 93 drives the developing rollers 51*c*. The fourth drive motor 94 drives the photosensitive drums 51*a*. The fifth drive motor 95 drives the fixing unit 60. The sixth drive motor 96 drives the sheet feeding roller 32, the separation roller 33, the conveyance roller pair 34, the resist roller pair 35, and the re-conveyance roller pair 73.

Figure 3:
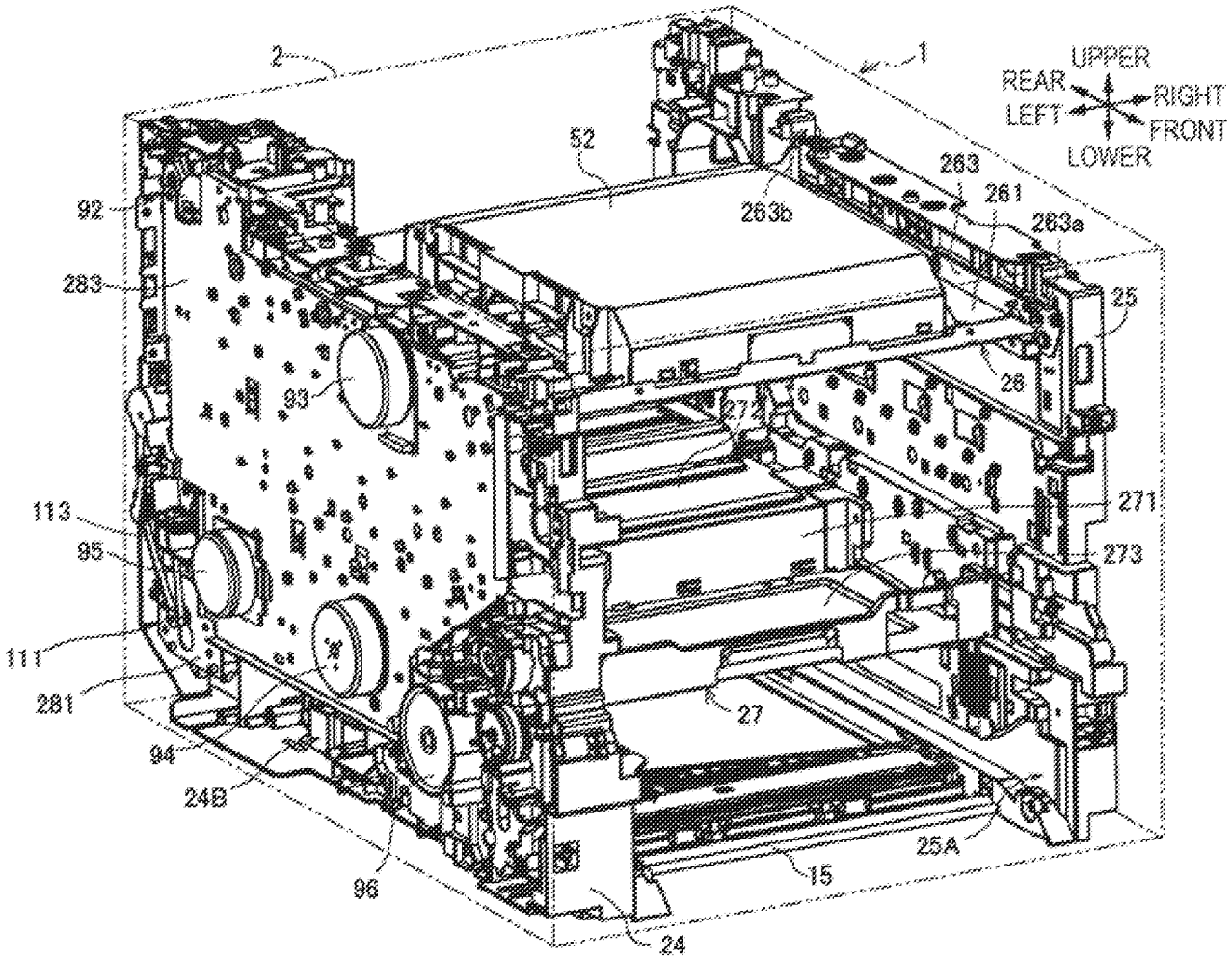
FIG. 3 is a left front perspective view showing a frame configuration.

As shown in FIG. 3, the image forming device 1 includes a first frame 24 and a second frame 25 that are provided in the main body 2. The first frame 24 and the second frame 25 are disposed to face each other in the left-right direction. The left-right direction is an example of a first direction in which the first frame 24 and the second frame 25 face each other.

The first frame 24 and the second frame 25 extend in the front-rear direction and the upper-lower direction. The first frame 24 is located at a left end portion in the main body 2, and the second frame 25 is located at a right end portion in the main body 2. The first frame 24 and the second frame 25 are disposed apart from each other in the left-right direction. The first frame 24 and the second frame 25 are made of resin.

The drawer 8 is located between the first frame 24 and the second frame 25 in the left-right direction. The first frame 24 has, in the left-right direction, an inner side surface 24A facing the drawer 8 and an outer side surface 24B on a side opposite to the inner side surface 24A. The inner side surface 24A is an inner surface of the first frame 24 in the left-right direction, and the outer side surface 24B is an outer surface of the first frame 24 in the left-right direction. The second frame 25 has, in the left-right direction, an inner side surface 25A facing the drawer 8 and an outer side surface 25B on a side opposite to the inner side surface 25A. The inner side surface 25A is an inner surface of the second frame 25 in the left-right direction, and the outer side surface 25B is an outer surface of the second frame 25 in the left-right direction.

The image forming device 1 includes a first plate 26 that connects the first frame 24 and the second frame 25 at an upper portion of the main body 2, and a second plate 27 that connects the first frame 24 and the second frame 25 at a lower portion of the main body 2. The first plate 26 and the second plate 27 are formed of metal plates that extend in the front-rear direction, and have high rigidity.

The first plate 26 includes a beam portion 261 bridged between the first frame 24 and the second frame 25 and having a plate surface facing the upper-lower direction, a support portion 262 bent upward from a left end portion of the beam portion 261 and having a plate surface facing the first frame 24, and a support portion 263 bent upward from a right end portion of the beam portion 261 and having a plate surface facing the second frame 25. The beam portion 261 of the first plate 26 supports the scanner unit 52 from below (see FIGS. 1 and 3, for example).

Figure 4:
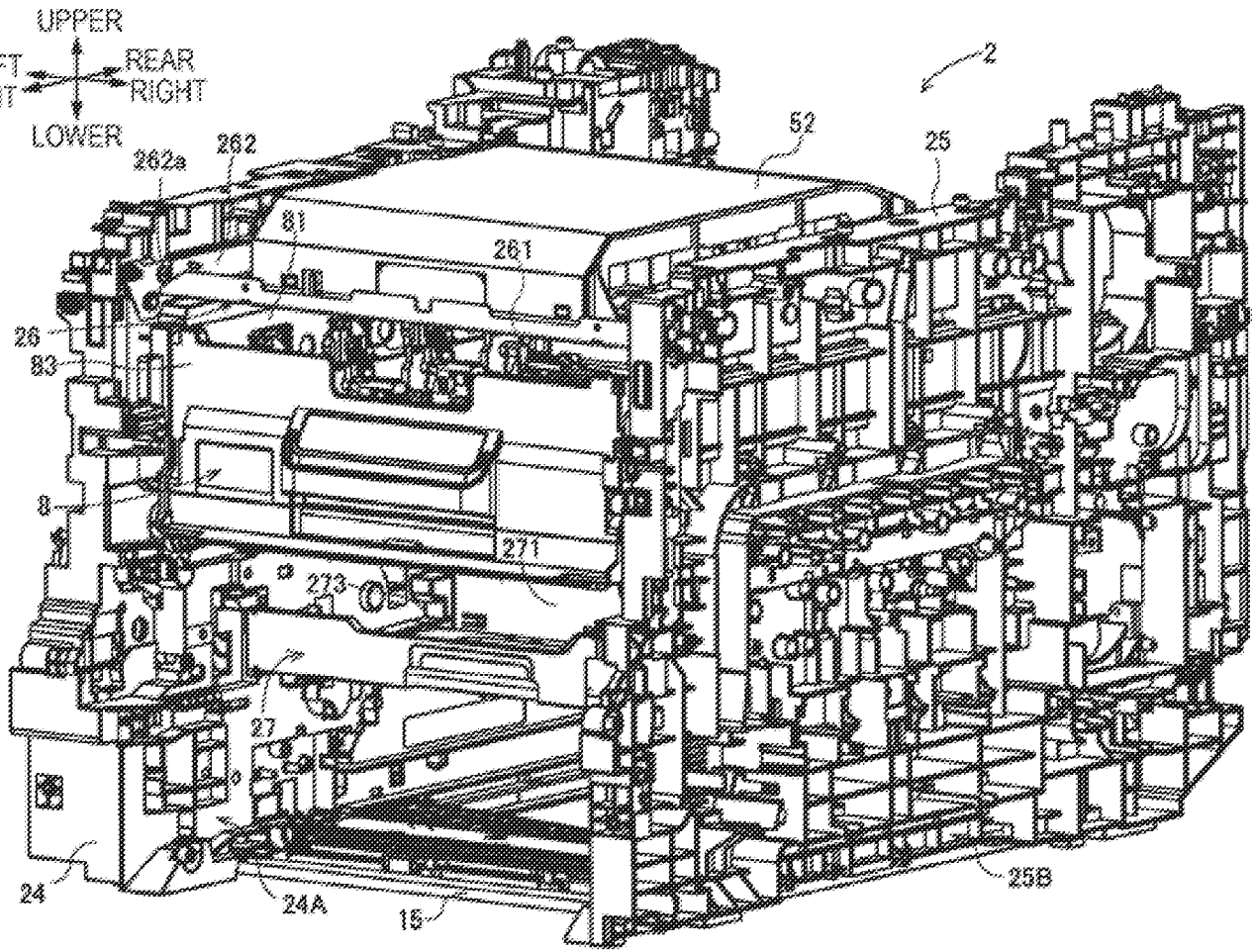
FIG. 4 is a right front perspective view showing the frame configuration.
Figure 5:
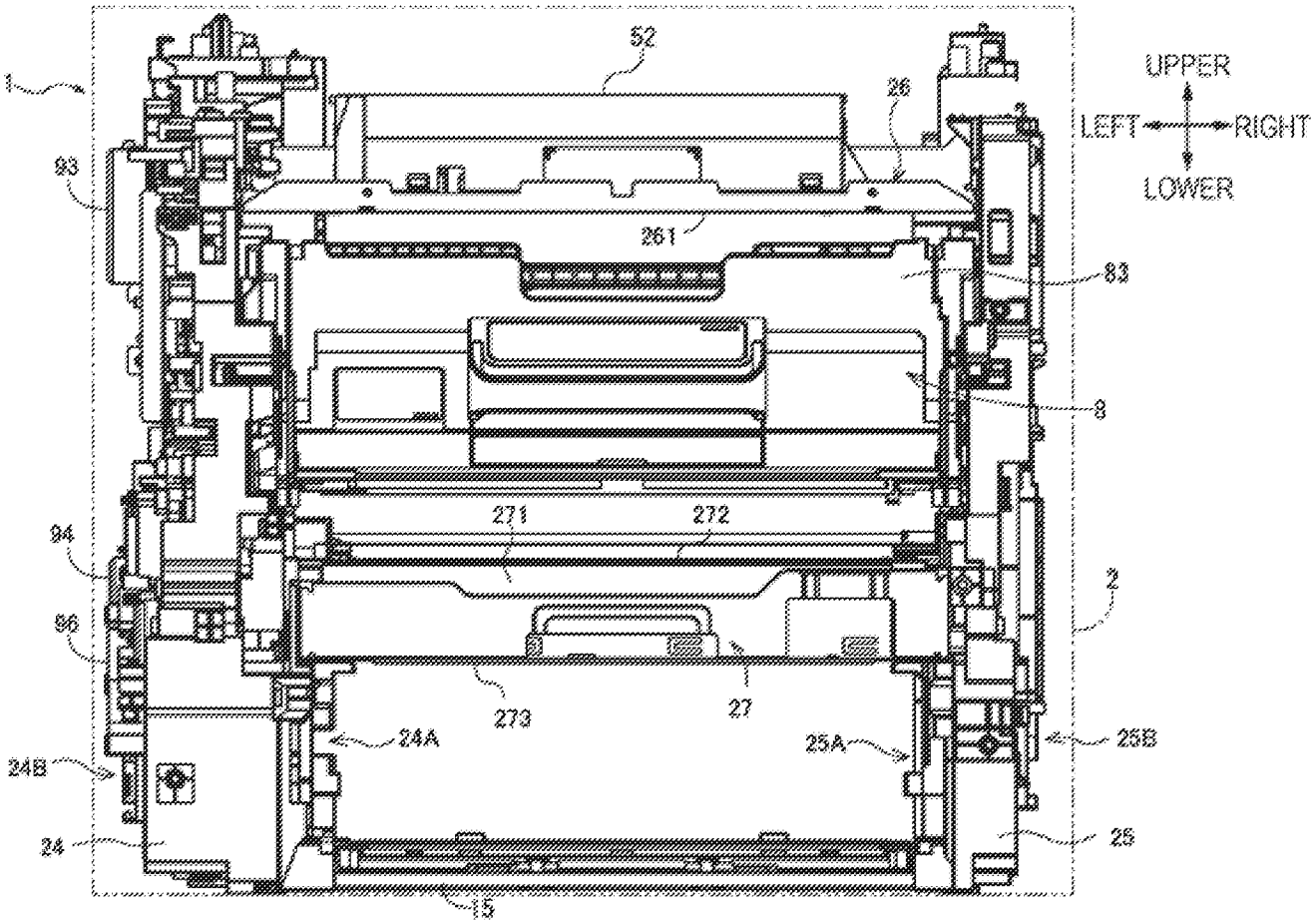
FIG. 5 is a front view showing the frame configuration.
Figure 12:
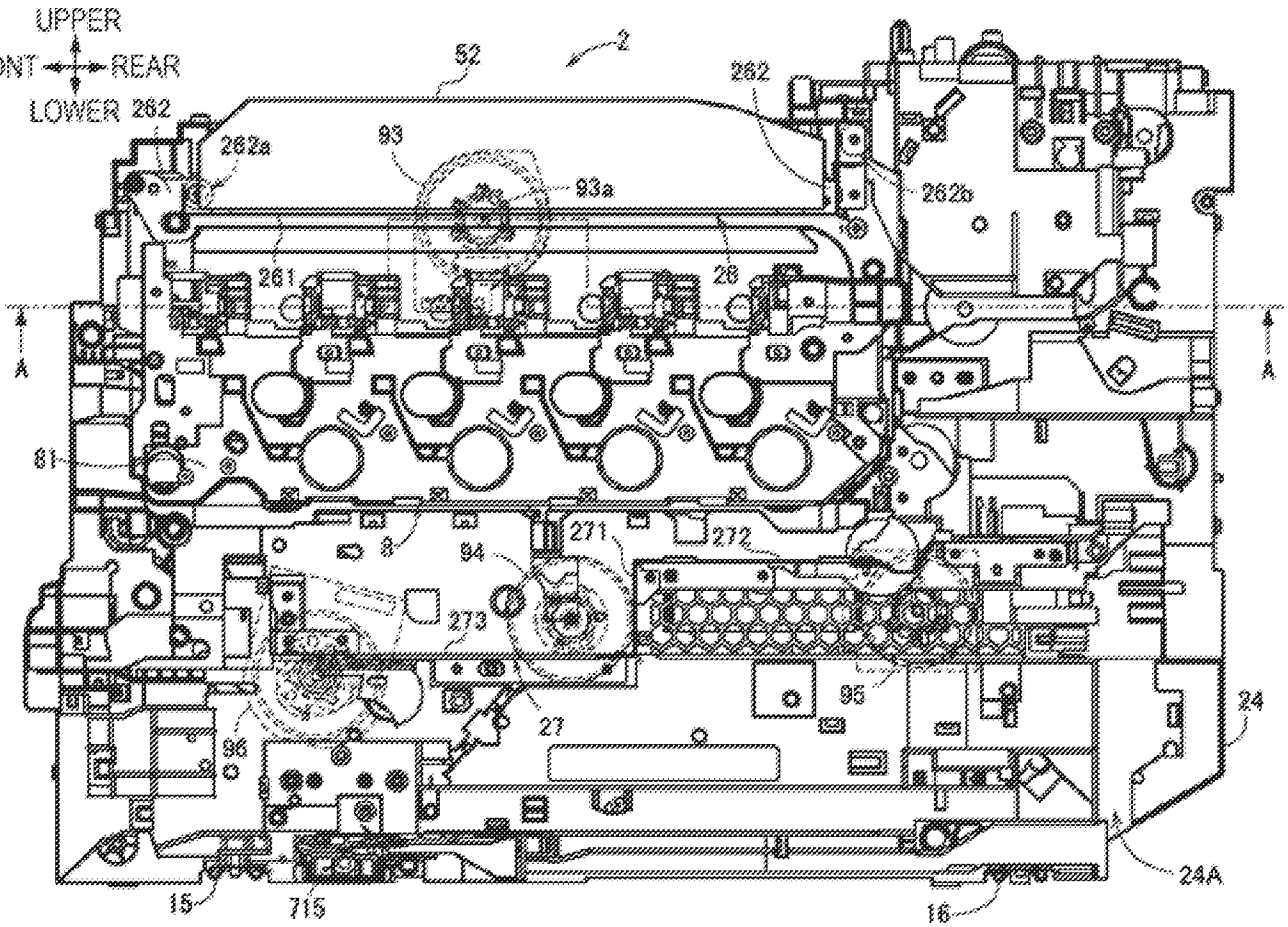
FIG. 12 is a side cross-sectional view of the first frame as viewed from an inner surface side.

As shown in FIGS. 4 and 12, the support portion 262 of the first plate 26 includes a plurality of plate fixing points 262*a*, 262*b*. The first plate 26 is fixed to the inner side surface 24A of the first frame 24 at the plurality of plate fixing points 262*a*, 262*b*. The plate fixing point 262*a* is located at a front end portion of the first plate 26, and the plate fixing point 262*b* is located at a rear end portion of the first plate 26. The plate fixing points 262*a*, 262*b* fixed to the first frame 24 are fastened to the first frame 24 by fastening members such as screws.

As shown in FIG. 3, the support portion 263 of the first plate 26 has a plurality of plate fixing points 263*a*, 263*b*. The first plate 26 is fixed to the inner surface 25A of the second frame 25 at the plurality of plate fixing points 263*a*, 263*b*. The plate fixing point 263*a* is located at the front end portion of the first plate 26, and the plate fixing point 263*b* is located at the rear end portion of the first plate 26. The plate fixing points 263*a*, 263*b* fixed to the second frame 25 are fastened to the second frame 25 by fastening members such as screws.

As shown in FIG. 1, the first plate 26 supports the scanner unit 52 from below. The second plate 27 is bent at an intermediate portion in the front-rear direction, a front portion thereof supports the belt cleaner unit 85 from below, and a rear portion thereof covers an upper portion of the power supply unit 86.

Figure 11:
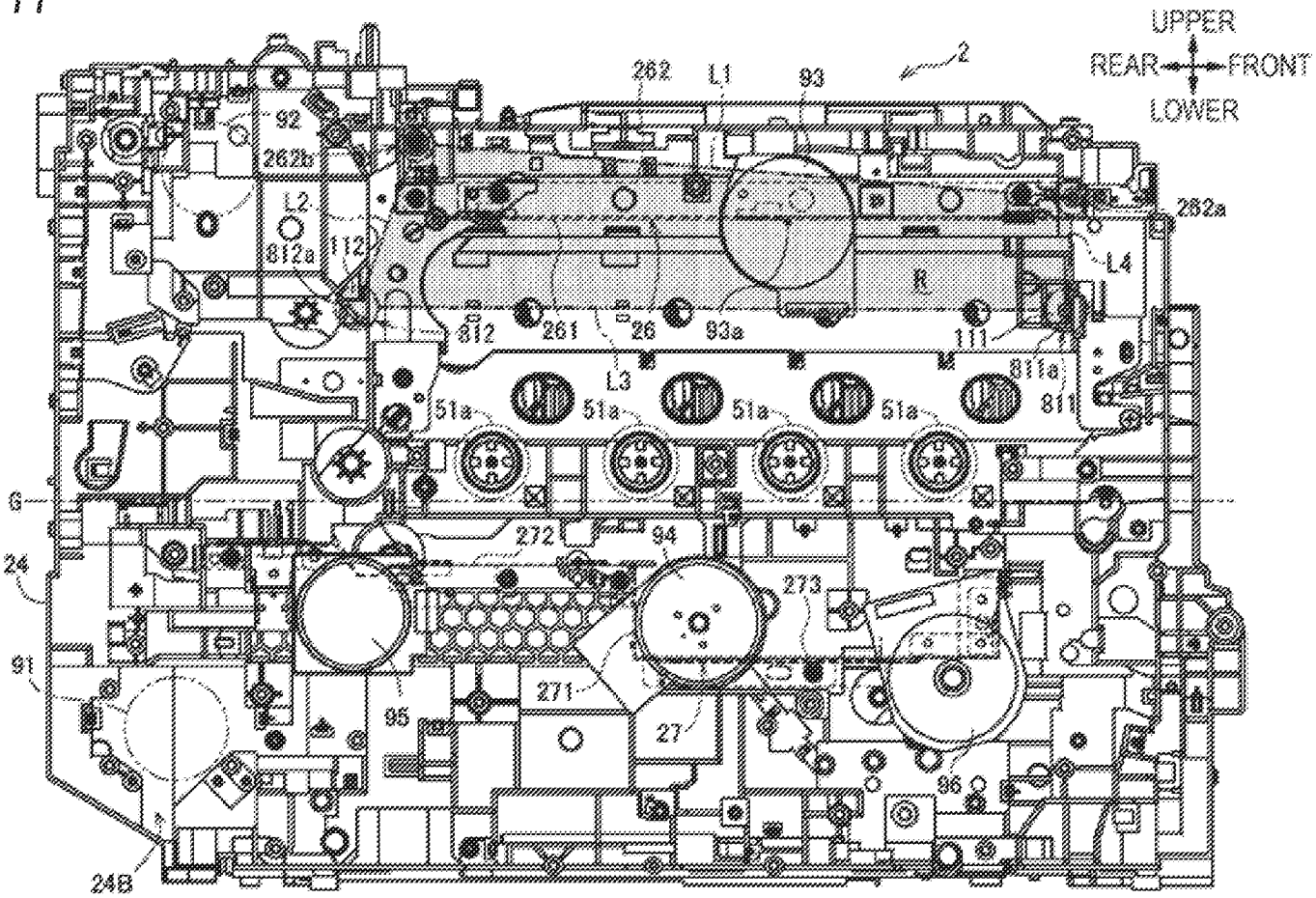
FIG. 11 is a side view showing a rigidity region in a first frame and support positions of each drive motor.

As shown in FIGS. 3 and 11, the second plate 27 extends in the front-rear direction. The second plate 27 includes a bent portion 271 bent at an intermediate portion in the front-rear direction, a first portion 272 located on a rear side of the bent portion 271 in the front-rear direction, and a second portion 273 located on a front side of the bent portion 271 in the front-rear direction.

The image forming device 1 includes a connection frame 15 and a connection frame 16 that connect a lower end portion of the first frame 24 and a lower end portion of the second frame 25 in the main body 2. In the front-rear direction, the connection frame 15 is located at a front portion of the main body 2, and the connection frame 16 is located at a rear portion of the main body 2. In the upper-lower direction, the connection frame 15 and the connection frame 16 are located below the second plate 27. The connection frame 15 and the connection frame 16 are formed of metal plates.

Figure 6:
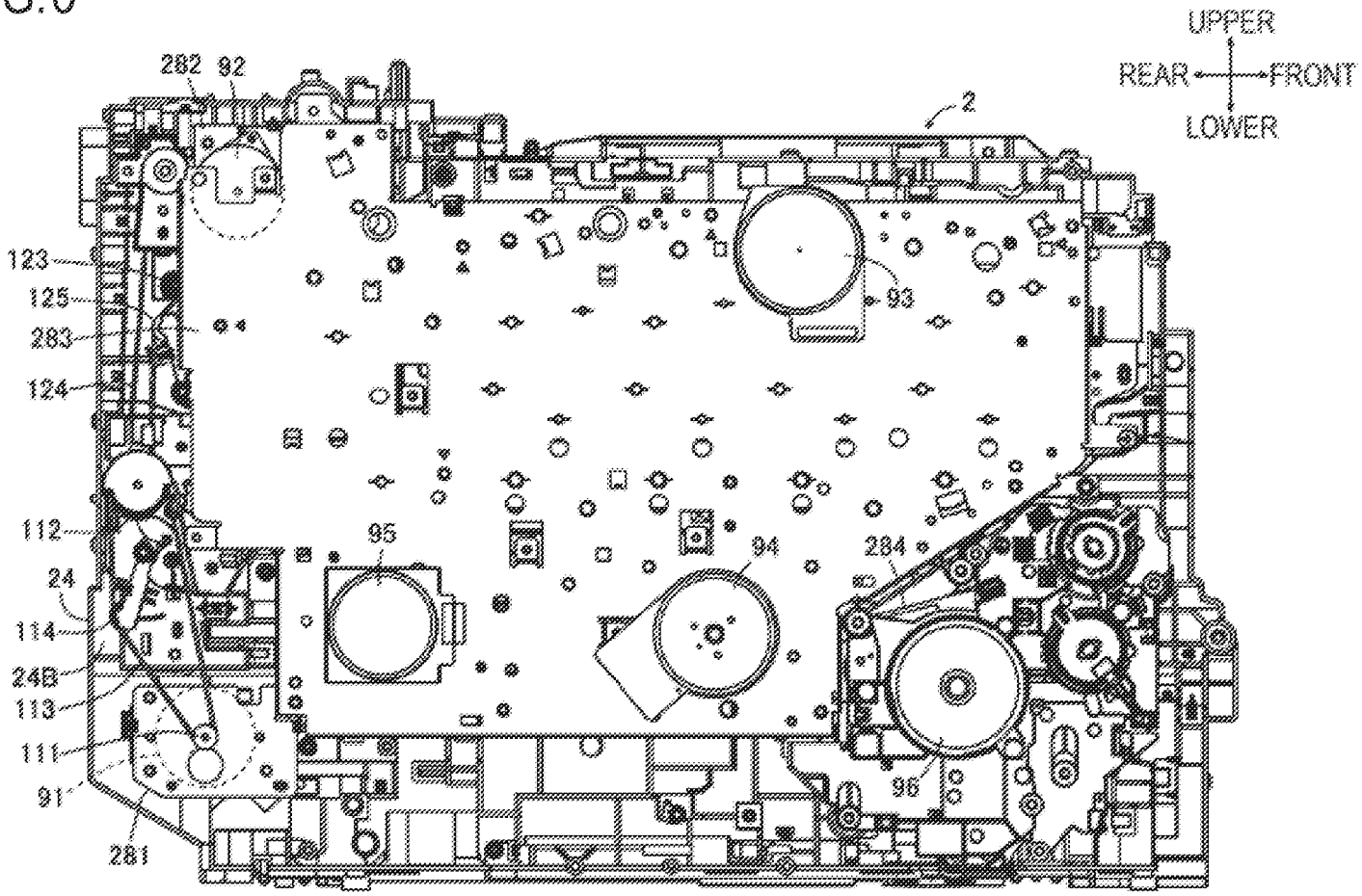
FIG. 6 is a left side view showing arrangement of the drive motors.
Figure 7:
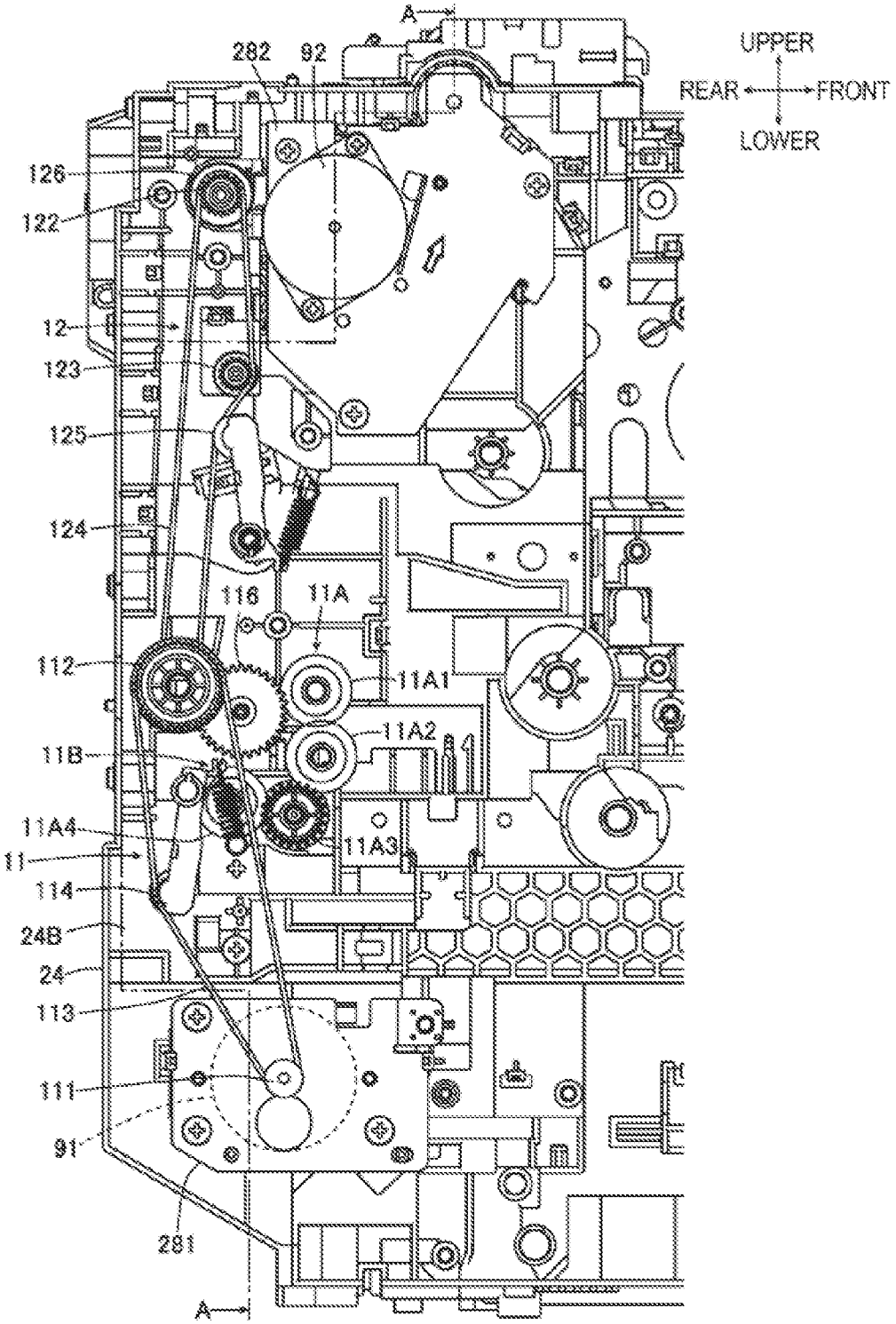
FIG. 7 is a left side view of a part around drive transmission paths.
Figure 13:
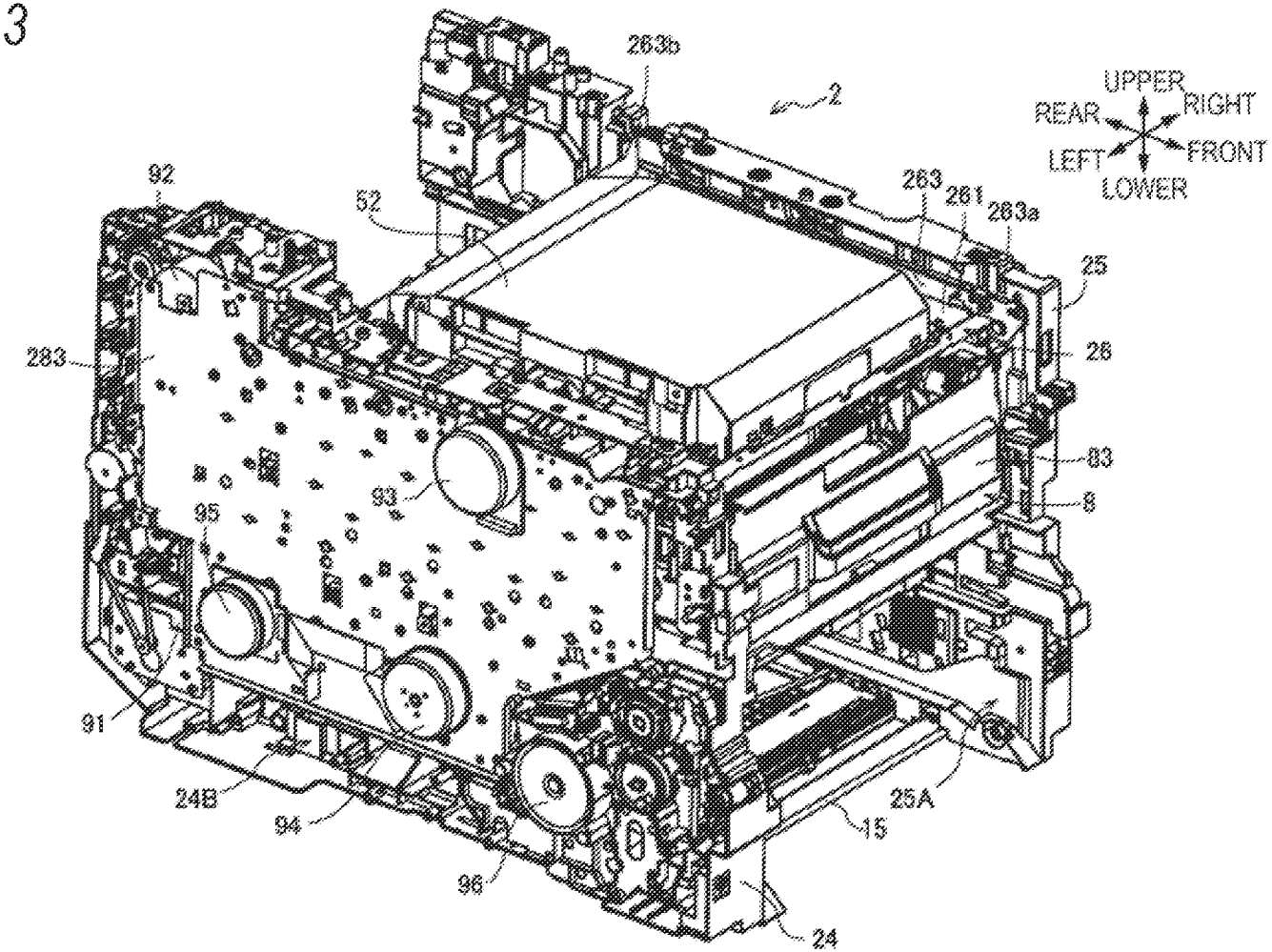
FIG. 13 is a left front perspective view showing the frame configuration in a state where a drawer is attached.

As shown in FIGS. 3, 6, 13, for example, the first drive motor 91, the second drive motor 92, the third drive motor 93, the fourth drive motor 94, the fifth drive motor 95 and the sixth drive motor 96 are supported on a side of the outer side surface 24B of the first frame 24.

The first drive motor 91 is located below the conveyance roller 721. The first drive motor 91 is attached to a metal plate 281 as an example of a drive motor support member, and the metal plate 281 is attached to the outer side surface 24B of the first frame 24.

Figure 8:
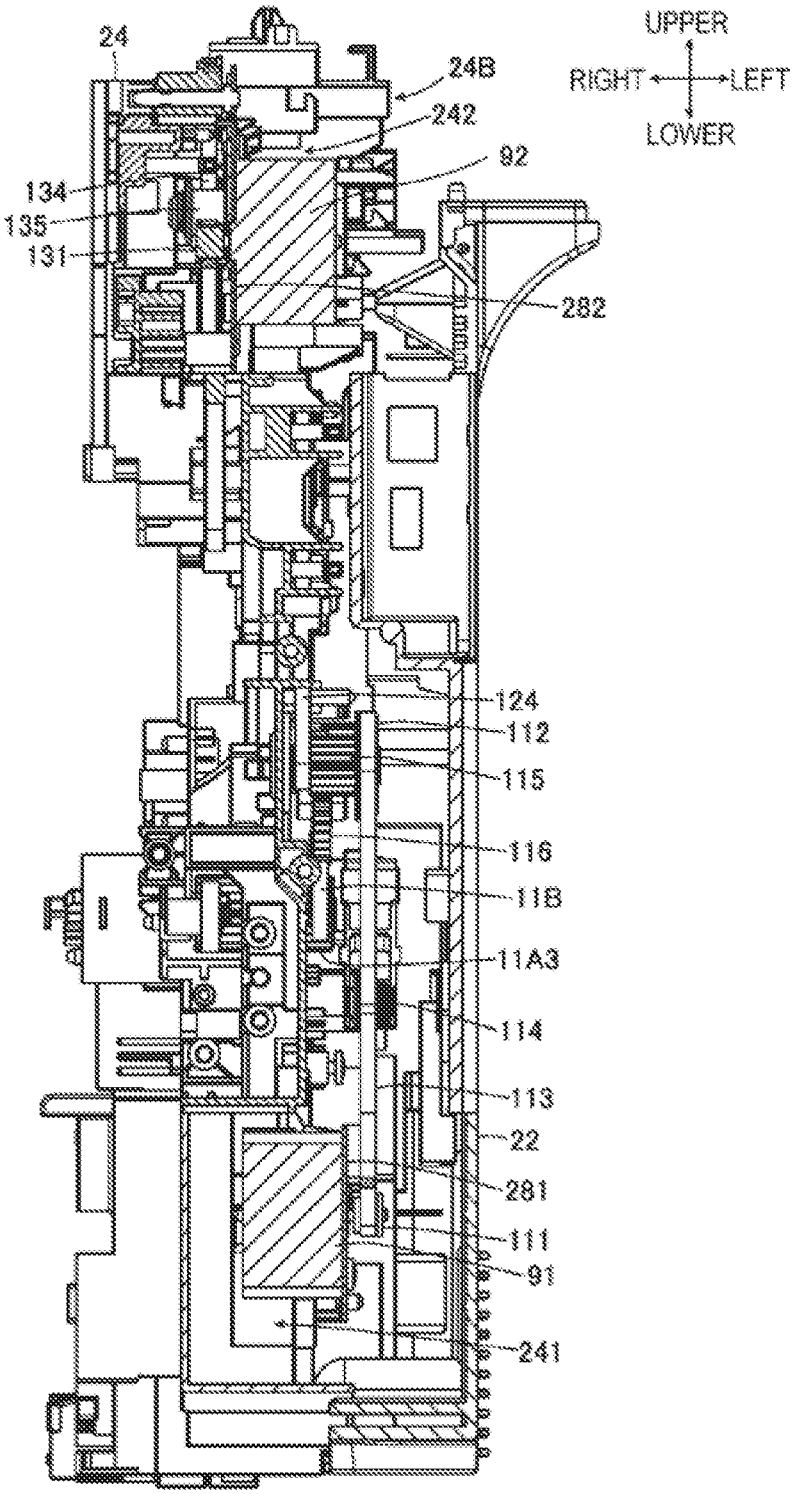
FIG. 8 is a cross-sectional view taken along a line A-A in FIG. 7.

As shown in FIG. 8, a part of the first drive motor 91 is located in a recess 241 formed in the outer side surface 24B of the first frame 24 and recessed rightward. Therefore, since the first drive motor 91 is disposed at the back of the image forming device 1 by the recess 241, noise leaking from the first drive motor 91 to outside of the image forming device 1 can be reduced. The recess 241 may have a size that accommodates the entire first drive motor 91.

The metal plate 281 is attached to the first frame 24 so as to cover the recess 241. The outer side surface 24B of the first frame 24 is covered with a side surface cover 22. Therefore, the metal plate 281 and the side surface cover 22 can further reduce the noise leaking from the first drive motor 91 to the outside of the image forming device 1.

As shown in FIG. 1, the second drive motor 92 is located between the conveyance roller 741 and the conveyance roller 751 in the upper-lower direction. As shown in FIG. 6, the second drive motor 92 is attached to a metal plate 282, and the metal plate 282 is attached to the outer side surface 24B of the first frame 24.

As shown in FIG. 8, a part of the second drive motor 92 is located in a recess 242 formed in the outer side surface 24B of the first frame 24 and recessed rightward. Therefore, since the second drive motor 92 is disposed at the back of the image forming device 1 by the recess 242, noise leaking from the second drive motor 92 to the outside of the image forming device 1 can be reduced. The recess 242 may have a size that accommodates the entire second drive motor 92.

As shown in FIG. 1, in the image forming device 1, the first drive motor 91 and the second drive motor 92 are disposed at the rear portion of the main body 2, and the first drive motor 91 is disposed below the branch position Ps while the second drive motor 92 is disposed above the branch position Ps. In this way, the second drive motor 92 and the first drive motor 91 are disposed in the upper-lower direction with the branch position Ps being located therebetween, whereby a distance between the two drive motors 91, 92 becomes large and drive transmission paths thereof are less likely to interfere with each other, so that a size of the image forming device 1 can be reduced.

The first drive motor 91 is located below the second plate 27, and the second drive motor 92 is located above the second plate 27. In this way, the first drive motor 91 and the second drive motor 92 are disposed with the second plate 27 being located therebetween, whereby resonance between the first drive motor 91 and the second drive motor 92 is prevented, and vibration of the image forming device 1 is prevented.

As shown in FIG. 6, the third drive motor 93, the fourth drive motor 94 and the fifth drive motor 95 are attached to a metal plate 283, and the metal plate 283 is attached to the outer side surface 24B of the first frame 24. The sixth drive motor 96 is attached to a metal plate 284, and the metal plate 284 is attached to the outer side surface 24B of the first frame 24.

As shown in FIG. 1, the third drive motor 93 is disposed above the photosensitive drums 51*a*, which is in an upper portion of the main body 2. The fourth drive motor 94, the fifth drive motor 95 and the sixth drive motor 96 are disposed below the photosensitive drums 51*a*, which is in a lower portion of the main body 2.

The sixth drive motor 96 is located in front of the fourth drive motor 94 and the fifth drive motor 95, and the fourth drive motor 94 is located in front of the fifth drive motor 95. The sixth drive motor 96 is located lower than the fourth drive motor 94 and the fifth drive motor 95.

As shown in FIGS. 7 to 10, the image forming device 1 includes a drive transmission path 11 from the first drive motor 91 to the conveyance roller 721 and a drive transmission path 12 from the conveyance roller 721 to the conveyance roller 711. In addition, the image forming device 1 includes a drive transmission path 13 from the second drive motor 92 to the conveyance roller 751 and the conveyance roller 741.

In the drive transmission path 11, a pulley 111 attached to the first drive motor 91, a pulley 112 disposed in vicinity of the conveyance roller 721, and a second belt 113 hung on the two pulleys 111, 112 are disposed. A tension is applied to the second belt 113 by a tension pulley 114. The noise can be reduced by using the second belt 113 as a means for transmitting a driving force from the first drive motor 91 to the conveyance roller 721.

Figure 10:
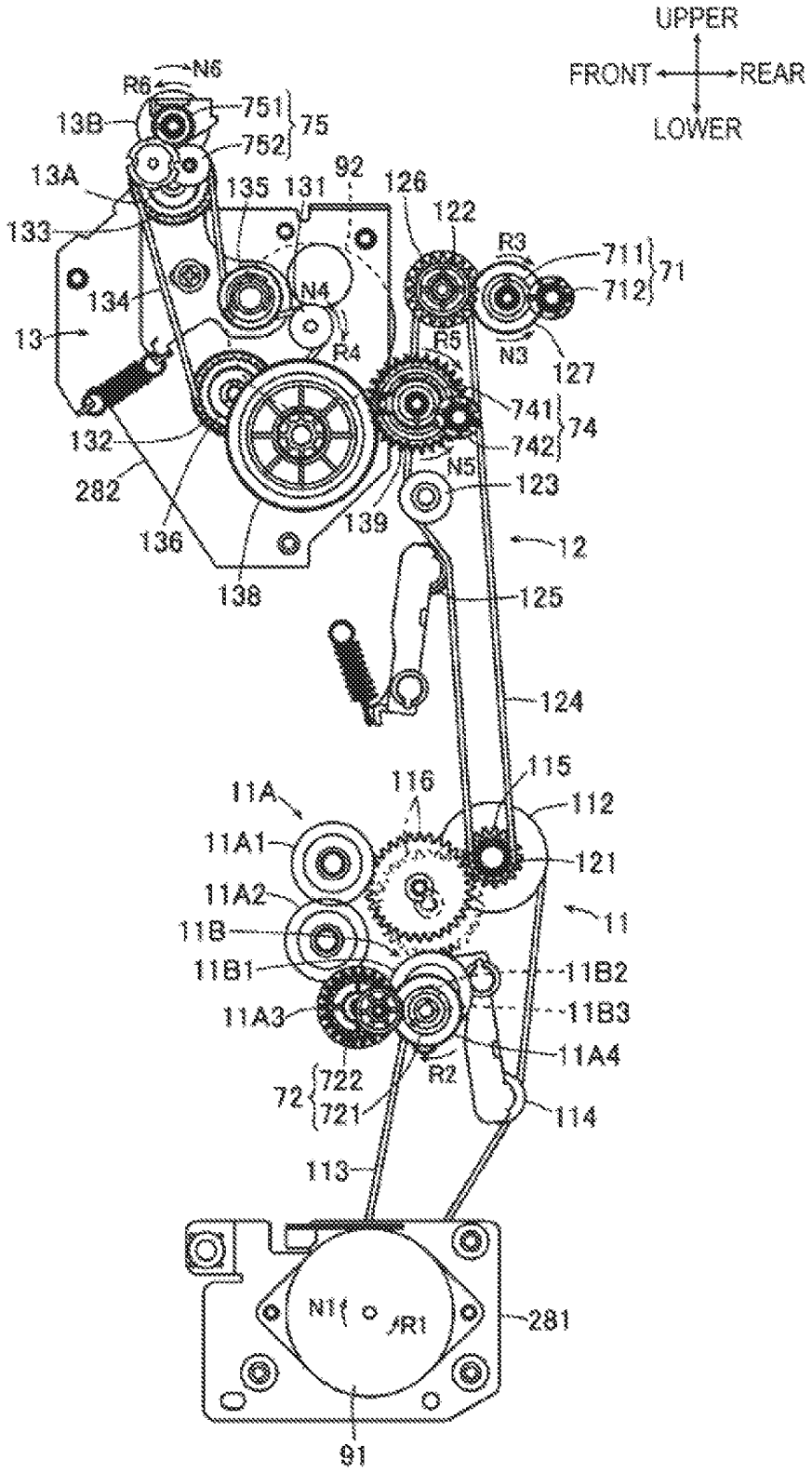
FIG. 10 is a right side view showing the drive transmission paths.

As viewed in an axial direction of the first drive motor 91, for example, in a right direction as shown in FIG. 10, the second belt 113 and the conveyance roller 721 overlap each other. The second belt 113 and the conveyance roller 721 are disposed so as to overlap each other in the left-right direction, whereby the second belt 113 and the conveyance roller 721 can be arranged in a space-saving manner and the size of the image forming device 1 can be reduced.

In the drive transmission path 11, a gear 115 fixed coaxially with the pulley 112, and a pendulum gear 116 meshing with the gear 115 and movable between a first position (a position shown by a solid line in FIGS. 9 and 10) and a second position (a position shown by a two-dot chain line in FIGS. 9 and 10) are disposed. The pendulum gear 116 is located at the first position when the first drive motor 91 rotates normally, and is located at the second position when the first drive motor 91 rotates reversely.

As shown in FIG. 10, the second belt 113 and the pendulum gear 116 overlap each other as viewed in the right direction. The second belt 113 and the pendulum gear 116 are disposed so as to overlap each other in the left-right direction, the second belt 113 and the pendulum gear 116 can be disposed in a space-saving manner and the size of the image forming device 1 can be reduced.

The drive transmission path 11 includes a first drive transmission path 11A that transmits the driving force to the conveyance roller 721 when the pendulum gear 116 is at the first position, and a second drive transmission path 11B that transmits the driving force to the conveyance roller 721 when the pendulum gear 116 is at the second position.

The first drive transmission path 11A is a path through which the driving force from the first drive motor 91 that rotates normally is transmitted to the conveyance roller 721 and the conveyance roller 721 is rotated in one direction in which the sheet S is conveyed toward the image forming unit 5. The second drive transmission path 11B is a path through which the driving force from the first drive motor 91 that rotates reversely is transmitted to the conveyance roller 721 and the conveyance roller 721 is rotated in the one direction in which the sheet S is conveyed toward the image forming unit 5.

In the first drive transmission path 11A, a gear 11A1 meshing with the pendulum gear 116 at the first position, a gear 11A2 meshing with the gear 11A1, a gear 11A3 meshing with the gear 11A2, and a gear 11A4 meshing with the gear 11A3 and fixed coaxially with the conveyance roller 721 are disposed.

In the second drive transmission path 11B, a gear 11B1 meshing with the pendulum gear 116 at the second position, a gear 11B2 fixed coaxially with the gear 11B1, and a gear 11B3 meshing with the gear 11B2 and fixed coaxially with the conveyance roller 721 are disposed.

Figure 9:
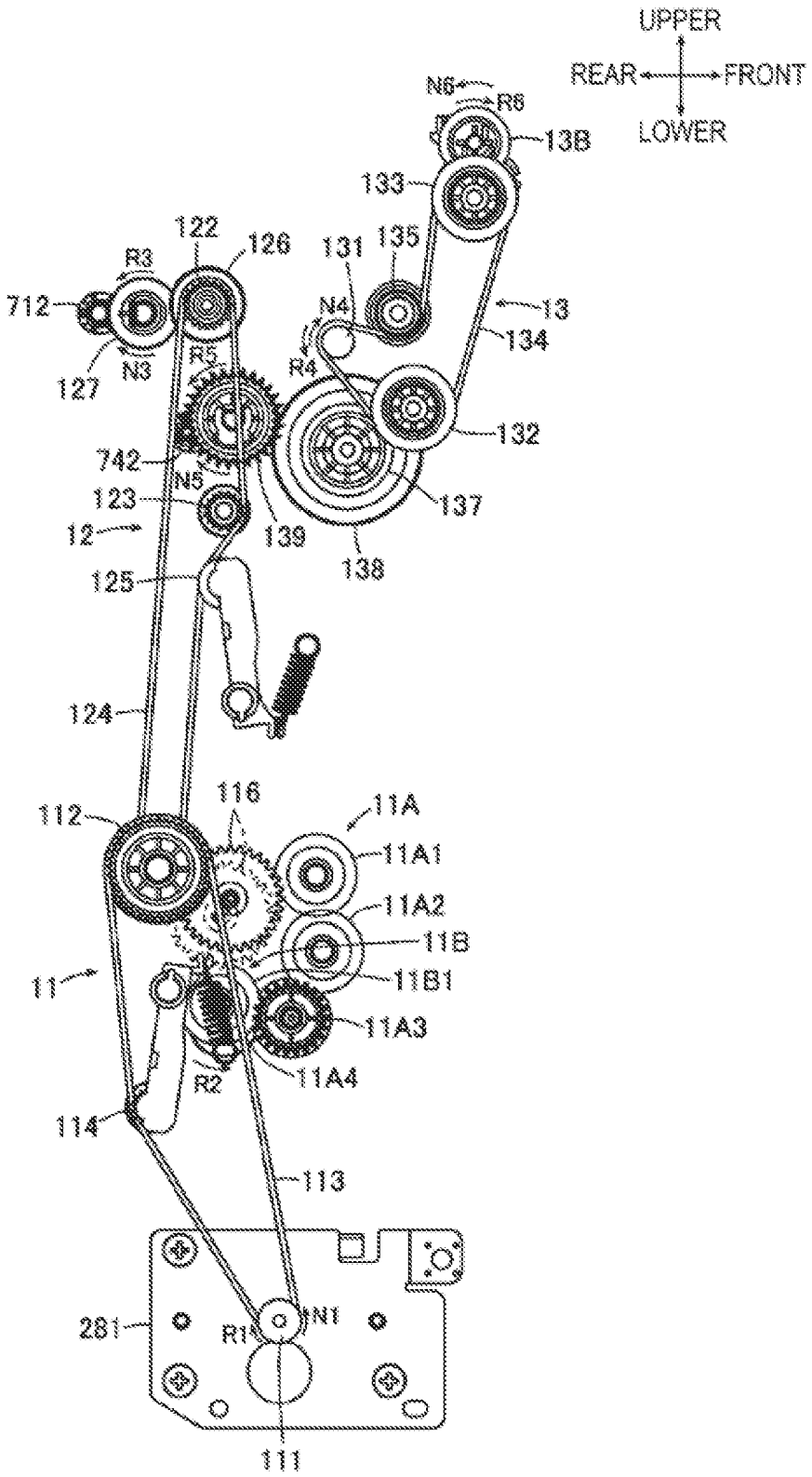
FIG. 9 is a left side view showing the drive transmission paths.

As shown in FIGS. 9 and 10, when the first drive motor 91 rotates normally in a direction of an arrow N1, the second belt 113 is driven, and the pendulum gear 116 is moved to the first position by rotation of the gear 115 to mesh with the gear 11A1. Thereby, the driving force is transmitted through the first drive transmission path 11A, and the conveyance roller 721 rotates in a direction of an arrow R2.

On the other hand, when the first drive motor 91 is rotates reversely in a direction of an arrow R1, the second belt 113 is driven, and the pendulum gear 116 is moved to the second position by rotation of the gear 115 to mesh with the gear 11B1. Thereby, the driving force is transmitted through the second drive transmission path 11B, and the conveyance roller 721 rotates in the direction of the arrow R2. That is, when the first drive motor 91 is driven, the conveyance roller 721 rotates in the direction of the arrow R2 in which the sheet S can be conveyed to the image forming unit 5 regardless of an rotation direction of the first drive motor 91.

Therefore, the conveyance roller 721 can alternately convey the sheet S conveyed from the conveyance path P2 and the sheet S conveyed from the conveyance path P4. Accordingly, an conveyance interval of the sheet S passing through the conveyance path P3 can be shortened, and a speed of the duplex printing can be increased.

In the drive transmission path 12, a pulley 121 fixed coaxially with the pulley 112, a pulley 122 disposed in vicinity of the conveyance roller 711, a pulley 123 disposed between the two pulleys 121, 122, and a first belt 124 hung on the three pulleys 121, 122, 123 are disposed. A tension is applied to the first belt 124 by a tension pulley 125.

In the drive transmission path 12, a gear 126 fixed coaxially with the pulley 122, and a gear 127 meshing with the gear 126 and fixed coaxially with the conveyance roller 711 are disposed.

As shown in FIGS. 9 and 10, when the first drive motor 91 rotates normally in the direction of the arrow N1, the second belt 113 and the first belt 124 are driven, and the conveyance roller 711 rotates in a direction of an arrow N3. On the other hand, when the first drive motor 91 rotates reversely in the direction of the arrow R1, the second belt 113 and the first belt 124 are driven, and the conveyance roller 711 rotates in a direction of an arrow R3. That is, the conveyance roller 711 rotates normally and reversely according to normal and reverse rotation of the first drive motor 91.

In this way, in a configuration in which the conveyance roller 711 and the first drive motor 91 are disposed in the upper-lower direction with the branch position Ps being located therebetween so that a transmission distance of driving becomes large, the noise can be reduced by using the first belt 124 as a means for transmitting the driving force from the first drive motor 91. Since the drive transmission path 12 is branched from the drive transmission path 11 and the driving force of the second belt 113 is transmitted to the first belt 124, the first belt 124 can be shortened.

In the drive transmission path 13, a pulley 131 attached to the second drive motor 92, a pulley 132 disposed in vicinity of the conveyance roller 741, a pulley 133 disposed in vicinity of the conveyance roller 751, and a third belt 134 hung on the three pulleys 131, 132, 133 are disposed. A tension is applied to the third belt 134 by a tension pulley 135. The noise can be reduced by using the third belt 134 as a means for transmitting a driving force from the second drive motor 92 to the conveyance roller 751 and the conveyance roller 741.

As shown in FIG. 10, the first belt 124 and the conveyance roller 741 overlap each other as viewed in right direction. The first belt 124 and the conveyance roller 741 are disposed so as to overlap each other in the left-right direction, whereby the first belt 124 and the conveyance roller 741 can be disposed in a space-saving manner and the size of the image forming device 1 can be reduced.

In the drive transmission path 13, a gear 136 fixed coaxially with the pulley 132, a gear 137 meshing with the gear 136 (see FIG. 9), a gear 138 fixed coaxially with the gear 137, and a gear 139 meshing with the gear 138 and fixed coaxially with the conveyance roller 741 are disposed. In the drive transmission path 13, a gear 13A fixed coaxially with the pulley 133, and a gear 13B meshing with the gear 13A and fixed coaxially with the conveyance roller 751 are disposed.

As shown in FIGS. 9 and 10, when the second drive motor 92 rotates normally in a direction of an arrow N4, the third belt 134 is driven, the conveyance roller 741 rotates in a direction of an arrow N5, and the conveyance roller 751 rotates in a direction of an arrow N6. On the other hand, when the second drive motor 92 rotates reversely in a direction of an arrow R4, the third belt 134 is driven, the conveyance roller 741 rotates in a direction of an arrow R5, and the conveyance roller 751 rotates in a direction of an arrow R6. That is, the conveyance roller 741 and the conveyance roller 751 rotate normally and reversely according to normal and reverse rotation of the second drive motor 92.

As shown in FIG. 10, in the image forming device 1, the conveyance roller 711 and the driven roller 742 are disposed at partially overlapping positions as viewed in the upper-lower direction. Therefore, since the conveyance roller 711 and the conveyance roller 741 serving as the drive rollers are densely arranged, the conveyance roller 711 and the conveyance roller 741 can be arranged in a space-saving manner by using the first belt 113 and the third belt 134 and the size of the image forming device 1 can be reduced. If the switchback roller pair 71 and the intermediate discharge roller pair 74 are disposed at partially overlapping positions as viewed in the upper-lower direction, similar effects as described above can be obtained.

The conveyance roller 711 is disposed above the conveyance roller 741. Thereby, the drive transmission path 12 from the first drive motor 91 to the conveyance roller 711 and the drive transmission path 13 from the second drive motor 92 to the conveyance roller 741 become large. However, since the first belt 124 and the third belt 134 are used, the noise can be reduced.

In each of the drive transmission paths 11, 12, 13, an order in which the pulleys and the gears are arranged is not particularly limited. That is, the first belt 124 may be disposed at any arrangement position in the drive transmission path 12. The second belt 113 may be disposed at any arrangement position in the drive transmission path 11. The third belt 134 may be disposed at any arrangement position in the drive transmission path 13. A drive transmission path from the first drive motor 91 to the conveyance roller 711 may be a path that does not pass through the drive transmission path 11 instead of the drive transmission path 12 described above. For example, the first belt 124 may be configured to be hung on a pulley attached to the first drive motor 91 and the pulley 122.

The conveyance roller 751 and the conveyance roller 741 which are disposed in the conveyance path P4 may be configured to rotate only in a direction in which the sheet S is discharged to the discharge tray 23*a*. In this case, the conveyance path P4 is a path that guides the sheet S that has been conveyed along the conveyance path P1 toward the discharge tray 23*a*.

The conveyance path P2, the switchback roller pair 71, and the flapper 77 may be omitted. In this case, the first belt 124 can be used as means for transmitting the driving force from the first drive motor 91 to the conveyance roller 741 or the conveyance roller 751.

Similar effects can be obtained by using drive shafts instead of the first belt 124, the second belt 113 and the third belt 134 used in the above embodiment.

As shown in FIG. 12, the drawer 8 is located between the first plate 26 and the second plate 27 in the upper-lower direction, and as shown in FIG. 13, the drawer 8 is located between the first frame 24 and the second frame 25 in the left-right direction. That is, the drawer 8 is located below the first plate 26 provided in the upper portion of the main body 2, and the second plate 27 is located below the drawer 8.

Figure 14:
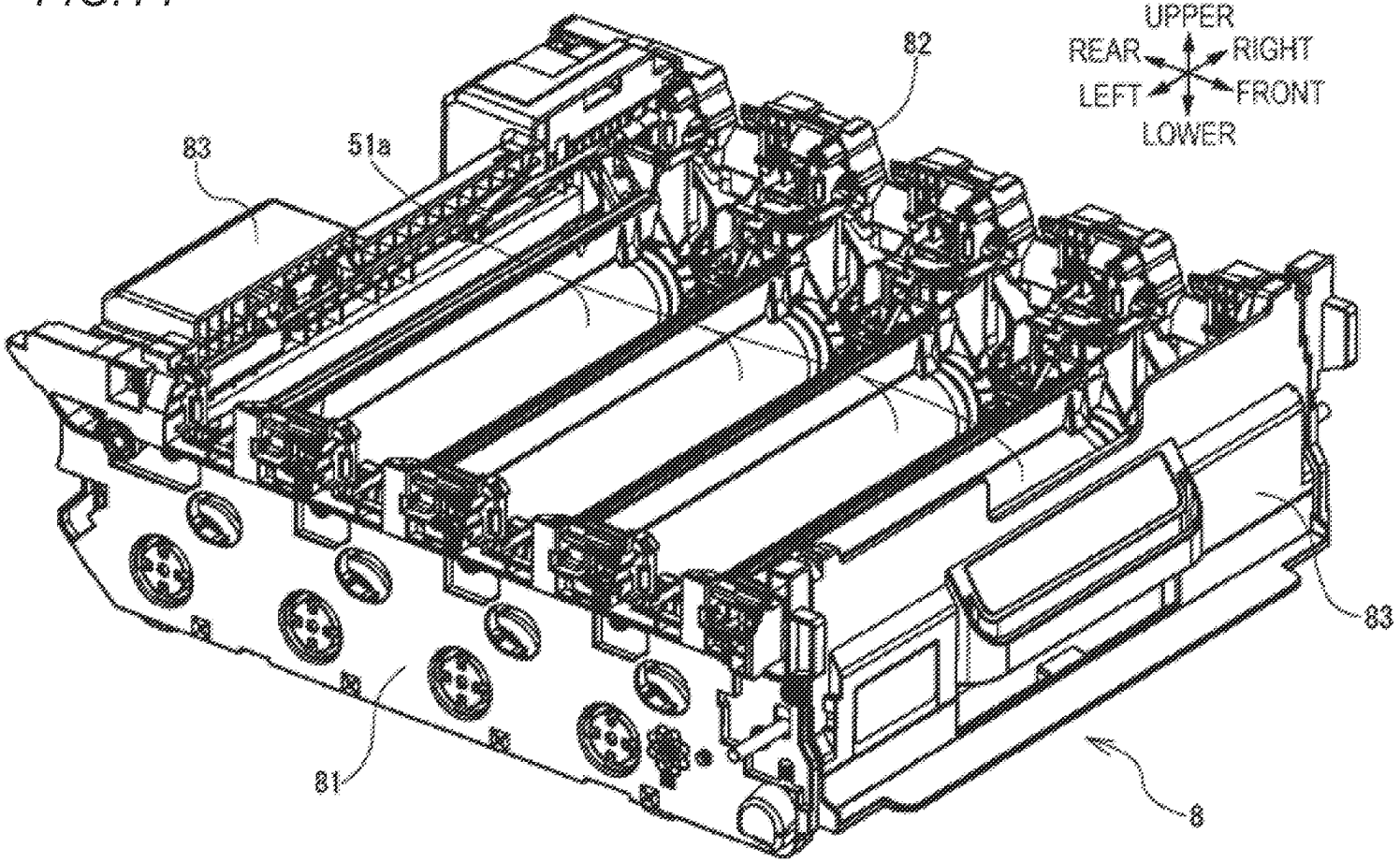
FIG. 14 is a left front perspective view showing the drawer.

As shown in FIG. 14, the drawer 8 includes a first side plate 81, a second side plate 82, and connection plates 83. The first side plate 81 is located at a left end portion of the drawer 8 and extends in the front-rear direction. The first side plate 81 faces the first frame 24. The second side plate 82 is located at a right end portion of the drawer 8 and extends in the front-rear direction. The second side plate 82 faces the second frame 25.

The connection plates 83 connect the first side plate 81 and the second side plate 82. The connection plates 83 are provided at a front end portion and a rear end portion of the drawer 8. The drawer 8 is formed in a box shape by the first side plate 81, the second side plate 82 and the connection plates 83, and has high rigidity.

Figure 15:
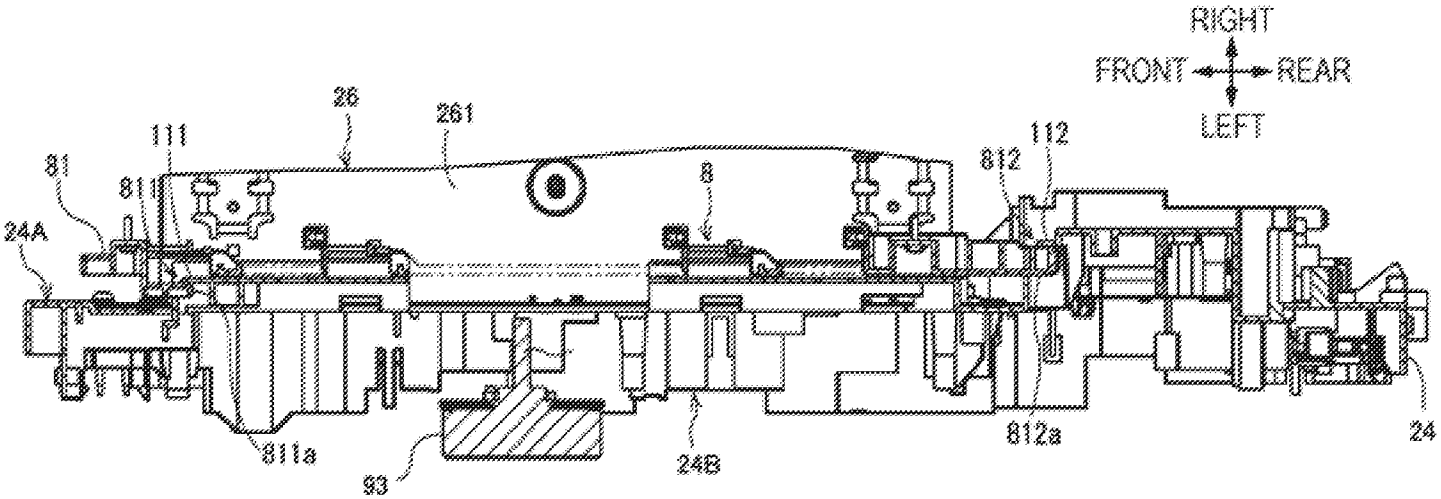
FIG. 15 is a cross-sectional view taken along a line A-A in FIG. 12.
Figure 16:
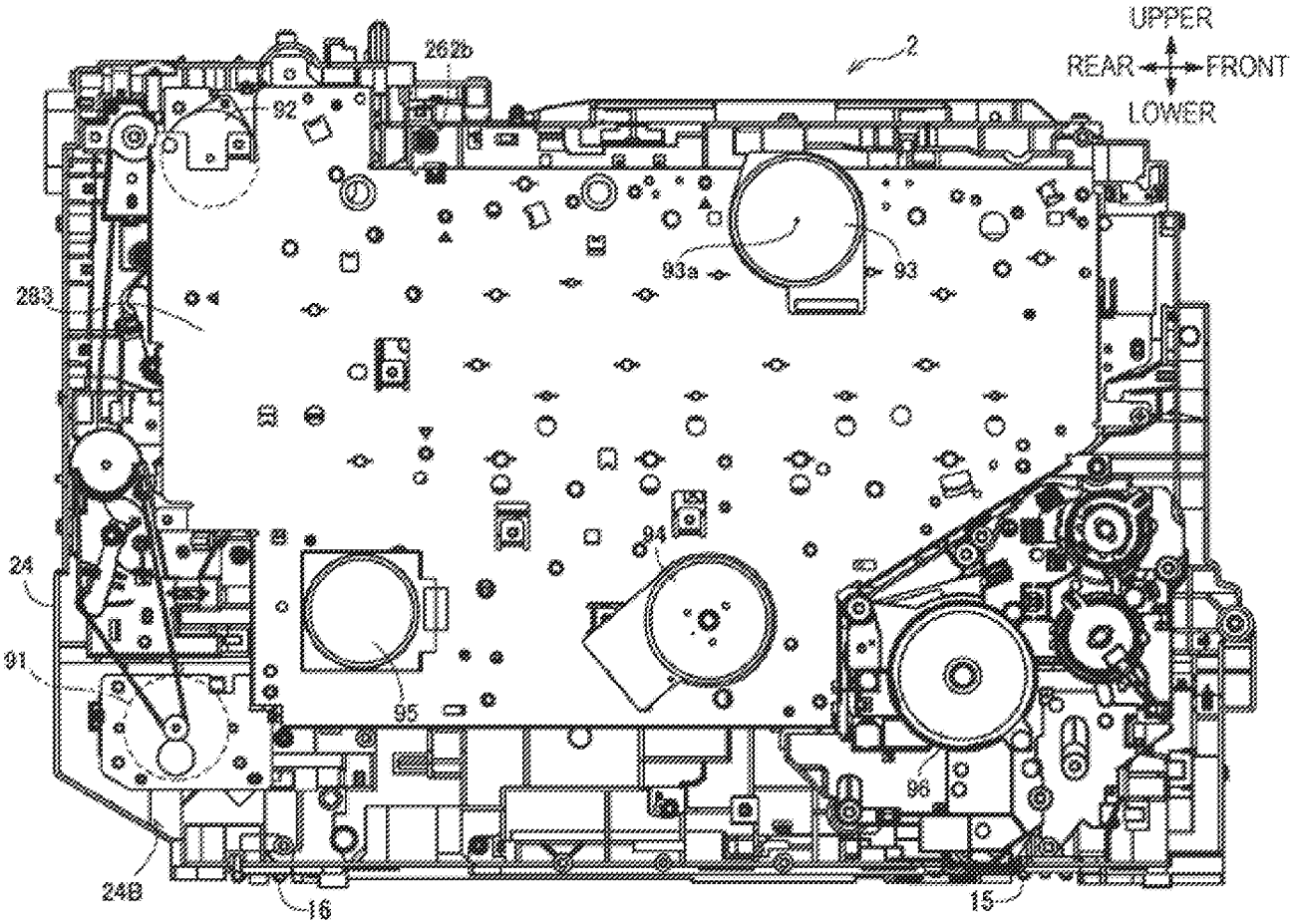
FIG. 16 is a side view showing a third drive motor, a fourth drive motor and a fifth drive motor that are supported by the first frame via a metal plate.

As shown in FIGS. 11 and 15, the first side plate 81 includes a plurality of drawer fixing points 811, 812. The drawer 8 is fixed to the inner side surface 24A of the first frame 24 at the plurality of drawer fixing points 811, 812 in a state where the drawer 8 is attached to the main body 2. The drawer fixing points 811, 812 are fixed to the first frame 24, whereby the drawer 8 is connected to the first frame 24. The drawer fixing point 811 is located at a front end portion of the first side plate 81, and the drawer fixing point 812 is located at a rear end portion of the first side plate 81.

An engaging portion 811*a* is formed at the drawer fixing point 811 of the first side plate 81. An engaging portion 812*a* is formed at the drawer fixing point 812 of the first side plate 81. An engaged portion 111 to be engaged with the engaging portion 811*a* is formed at a position corresponding to the drawer fixing point 811 in the first frame 24. An engaged portion 112 to be engaged with the engaging portion 812*a* is formed at a position corresponding to the drawer fixing point 812 in the first frame 24. By respectively engaging the engaging portions 811*a*, 812*a* with the engaged portions 111, 112, the drawer 8 is fixed to the first frame 24 in a state where the drawer 8 is positioned in the left-right direction.

In the present embodiment, the engaging portions 811*a*, 812*a* are formed in the first side plate 81, and the engaged portions 111, 112 are formed in the first frame 24. However, the engaging portions 811*a*, 812*a* may be formed in the first frame 24, and the engaged portions 111, 112 may be formed in the first side plate 81.

In this way, the first plate 26 is connected to an upper portion of the first frame 24, and the drawer 8 is connected to the first frame 24 below the first plate 26. The second plate 27 is connected to the first frame 24 below the drawer 8.

A position in the first frame 24 where the first plate 26 is connected, that is, a position in the first frame 24 where the first plate 26 is located as viewed in the left-right direction, has rigidity higher than that of a position in the first frame 24 where the first plate 26 is not connected. In particular, the rigidity of the first frame 24 is higher at positions corresponding to the plate fixing points 262*a*, 262*b*, which are positions in the first frame 24 where the first plate 26 is fixed.

A position in the first frame 24 where the drawer 8 is connected, that is, a position in the first frame 24 where the drawer 8 is located as viewed in the left-right direction, has rigidity higher than that of a position in the first frame 24 where the drawer 8 is not connected. In particular, the rigidity of the first frame 24 is higher at positions corresponding to the drawer fixing points 811, 812, which are positions in the first frame 24 where the drawer 8 is fixed.

A position in the first frame 24 where the second plate 27 is connected, that is, a position in the first frame 24 where the second plate 27 is located as viewed in the left-right direction, has rigidity higher than that of a position in the first frame 24 where the second plate 27 is not connected.

The first frame 24 has a rigidity region R (a shaded region in FIG. 11) where the plate fixing point 262*a*, the plate fixing point 262*b*, the drawer fixing point 812, and the drawer fixing point 811 serve as vertices. The rigidity region R is an example of a region of the first frame where the plate fixing points and the drawer fixing points serve as the vertices.

The rigidity region R is the region of the first frame 24 surrounded by a straight line L1 that connects the plate fixing point 262*a* and the plate fixing point 262*b*, a straight line L2 that connects the plate fixing point 262*b* and the drawer fixing point 812, a straight line L3 that connects the drawer fixing point 812 and the drawer fixing point 811, and a straight line L4 that connects the drawer fixing point 811 and the plate fixing point 262*a*.

Since the positions in the first frame 24 that correspond to the plate fixing points 262*a*, 262*b* and the drawer fixing points 811, 812 are positions having high rigidity, the rigidity region R of the first frame 24 where the plate fixing points 262*a*, 262*b* and the drawer fixing points 811, 812 serve as the vertices has high rigidity.

In the present embodiment, the first plate 26 has two plate fixing points 262*a*, 262*b*, but may also be configured to have three or more plate fixing points. Although the drawer 8 has two drawer fixing points 811, 812 in the present embodiment, but may also be configured to have three or more drawer fixing points.

When the first plate 26 has three or more plate fixing points, and when the drawer 8 has three or more drawer fixing points, the rigidity region R can be set by appropriately selecting the plurality of plate fixing points and drawer fixing points such that an area of the rigidity region R is the largest.

The third drive motor 93, the fourth drive motor 94, and the fifth drive motor 95 are attached to the metal plate 283, and the metal plate 283 is attached to the outer side surface 24B of the first frame 24. That is, the third drive motor 93, the fourth drive motor 94 and the fifth drive motor 95 are supported by the first frame 24 via the same metal plate 283.

The third drive motor 93 is supported by the first frame 24 at a position above the photosensitive drums 51*a*, which is in the upper portion of the main body 2. The fourth drive motor 94, the fifth drive motor 95 and the sixth drive motor 96 are supported by the first frame 24 at positions below the photosensitive drums 51*a*, which is in the lower portion of the main body 2.

As shown in FIG. 11, the third drive motor 93 is located above a gravity center position G of the main body 2 in the upper-lower direction. The third drive motor 93 is disposed on the outer side surface 24B of the first frame 24 such that at least a part of the third drive motor 93 is located in the rigidity region R as viewed in the left-right direction. In the present embodiment, a part of the third drive motor 93 at an upper end protrudes above the rigidity region R, and the other part is located in the rigidity region R.

Although the third drive motor 93, the fourth drive motor 94, and the fifth drive motor 95 are supported by the first frame 24 via the metal plate 283, the metal plate 283 is not shown in FIG. 11.

The third drive motor 93 is a heavy object and vibrates during driving to serve as a vibration source, and is disposed in the upper portion of the main body 2. However, since the third drive motor 93 is disposed such that at least a part of the third drive motor 93 is located in the rigidity region R of the first frame 24 having high rigidity, vibration that occurs during driving of the third drive motor 93 can be prevented, and image quality of the image formed by the image forming unit 5 can be stabilized and the noise can be reduced.

The third drive motor 93 has a rotation axis 93*a* serving as a rotation center, and is disposed such that the rotation axis 93*a* is located in the rigidity region R as viewed in the left-right direction. In this way, since the rotation axis 93*a* of the third drive motor 93 is located in the rigidity region R of the first frame 24 having high rigidity, the vibration that occurs during driving of the third drive motor 93 can be further reduced.

The third drive motor 93 is disposed at a position where at least a part of the third drive motor 93 overlaps the beam portion 261 of the first plate 26 as viewed in the left-right direction. Since a portion of the first frame 24 where the first plate 26 is connected has high rigidity, at least a part of the third drive motor 93 overlaps the first plate 26, so that the vibration that occurs during driving of the third drive motor 93 can be further reduced.

In the image forming device 1, the engaging portions 811*a*, 812*a* are formed at the drawer fixing points 811, 812 of the drawer 8 that constitute the vertices of the rigidity region R. By respectively engaging the engaging portions 811*a*, 812*a* with the engaged portions 111, 112 of the first frame 24, the drawer 8 is fixed to the first frame 24 in the state where the drawer 8 is positioned in the left-right direction. Thereby, the rigidity of the first frame 24 can be increased, and the vibration that occurs during driving of the third drive motor 93, at least a part of which is located in the rigidity region R, can be prevented.

The third drive motor 93 drives the developing roller 51*c*, and can prevent the vibration that occurs when the third drive motor 93 drives the developing roller 51*c*. Thereby, the image quality of the image formed by the image forming unit 5 can be stabilized and the noise can be reduced.

At least a part of the third drive motor 93 may be located in the rigidity region R as viewed in the left-right direction, for example, even when the rotation axis 93*a* is not located in the rigidity region R and only a part of the third drive motor 93 at the lower end is located in the rigidity region R, the vibration that occurs during driving can be prevented. In addition, even when the entire third drive motor 93 is located in the rigidity region R as viewed in the left-right direction, the vibration that occurs during driving can be prevented.

As shown in FIGS. 11 and 12, at least a part of the fourth drive motor 94, at least a part of the fifth drive motor 95 and at least a part of the sixth drive motor 96 overlap the second plate 27 as viewed in the left-right direction. Specifically, at least a part of the fifth drive motor 95 overlaps the first portion 272 of the second plate 27 as viewed in the left-right direction, and at least a part of the fourth drive motor 94 and at least a part of the sixth drive motor 96 overlap the second portion 273 of the second plate 27.

The sixth drive motor 96 is located in front of the fourth drive motor 94 and the fifth drive motor 95, and the fourth drive motor 94 is located in front of the fifth drive motor 95. The sixth drive motor 96 is located below the fourth drive motor 94 and the fifth drive motor 95.

In the image forming device 1, since the portion of the first frame 24 where the second plate 27 is connected has high rigidity, at least a part of the fourth drive motor 94, at least a part of the fifth drive motor 95 and at least a part of the sixth drive motor 96 overlap the second plate 27 as viewed in the left-right direction, so that vibration that occurs during driving of the fourth drive motor 94, the fifth drive motor 95 and the sixth drive motor 96 can be prevented.

In this case, the rigidity of the second plate 27 is increased by having the bent portion 271. Therefore, at least a part of the fifth drive motor 95 overlaps the first portion 272 located on one side of the bent portion 271 in the front-rear direction, so that the vibration that occurs during driving of the fifth drive motor 95 can be further reduced. At least a part of the fourth drive motor 94 and at least a part of the sixth drive motor 96 overlap the second portion 273 located on the other side of the bent portion 271 in the front-rear direction, so that the vibration that occurs during driving of the fourth drive motor 94 and the sixth drive motor 96 can be further reduced. However, the second plate 27 may be configured not to have the bent portion 271.

In the image forming device 1, since the third drive motor 93, the fourth drive motor 94 and the fifth drive motor 95 are supported by the first frame 24 in a state of being attached to the same metal plate 283, the vibration that occurs during driving of the third drive motor 93, the fourth drive motor 94 and the fifth drive motor 95 can be further reduced by the metal plate 283. However, in the image forming device 1, the metal plate 283 may not be provided, and for example, the third drive motor 93, the fourth drive motor 94 and the fifth drive motor 95 may be directly supported by the first frame 24.

In the image forming device 1, the first drive motor 91 and the second drive motor 92 are located at the rear portion of the main body 2, and the second drive motor 92 is located above the branch position Ps while the first drive motor 91 is located below the branch position Ps. The second drive motor 92 is located above the second plate 27, and the first drive motor 91 is located below the second plate 27.

The second drive motor 92 is located between the intermediate discharge roller pair 74 and the discharge roller pair 75 in the upper-lower direction. The first drive motor 91 is located below the intermediate re-conveyance roller pair 72.

What is claimed is:

1. A sheet conveyance device comprising:

a first conveyance path configured to allow a sheet to be conveyed along the first conveyance path;

a second conveyance path that extends upward from a branch position in the first conveyance path, the second conveyance path being configured to allow the sheet that has passed through the first conveyance path to be conveyed along the second conveyance path;

a third conveyance path that extends downward from the branch position, the third conveyance path being configured to allow the sheet that has passed through the second conveyance path to be conveyed along the third conveyance path;

a first conveyance roller disposed in the second conveyance path and configured to rotate normally and reversely to convey the sheet;

a first drive motor disposed below the branch position;

a first belt disposed in a drive transmission path from the first drive motor to the first conveyance roller and configured to transmit a driving force from the first drive motor to the first conveyance roller; and a main body, wherein the first drive motor is disposed closer to a lower end portion of the main body than an upper end portion of the main body in an upper-lower direction, wherein the first conveyance roller is disposed closer to the upper end portion of the main body than the lower end portion of the main body in the upper-lower direction, and wherein the sheet conveyance device includes:

a second conveyance roller disposed in the third conveyance path and configured to convey the sheet; and a second belt disposed in a drive transmission path from the first drive motor to the second conveyance roller and configured to transmit the driving force from the first drive motor to the second conveyance roller.

2. The sheet conveyance device according to claim 1, wherein the second belt and the second conveyance roller overlap each other as viewed in an axial direction of the first drive motor.

3. The sheet conveyance device according to claim 1, wherein the drive transmission path from the first drive motor to the first conveyance roller is branched from the drive transmission path from the first drive motor to the second conveyance roller, and wherein the driving force of the second belt is configured to be transmitted to the first belt.

4. The sheet conveyance device according to claim 1, wherein the first drive motor is configured to rotate normally and reversely, and wherein the sheet conveyance device further comprises:

a pendulum gear disposed in the drive transmission path from the first drive motor to the second conveyance roller and movable between a first position and a second position, the first position being a position where the driving force from the first drive motor that rotates normally is transmitted to the second conveyance roller to rotate the second conveyance roller in one direction, the second position being a position where the driving force from the first drive motor that rotates reversely is transmitted to the second conveyance roller to rotate the second conveyance roller in the one direction.

5. The sheet conveyance device according to claim 4, wherein the second belt and the pendulum gear overlap each other as viewed in the axial direction of the first drive motor.

6. The sheet conveyance device according to claim 1, further comprising:

a fourth conveyance path that extends upward from the branch position, the fourth conveyance path being configured to allow the sheet that has passed through the first conveyance path to be conveyed along the fourth conveyance path;

a third conveyance roller disposed in the fourth conveyance path and configured to convey the sheet;

a discharge tray configured to support the sheet discharged from the fourth conveyance path;

a second drive motor disposed above the branch position; and a third belt disposed in a drive transmission path from the second drive motor to the third conveyance roller and configured to transmit a driving force from the second drive motor to the third conveyance roller.

7. The sheet conveyance device according to claim 6, wherein the third conveyance roller is configured to rotate normally and reversely and to convey the sheet to the third conveyance path.

8. The sheet conveyance device according to claim 6, further comprising:

a first frame that supports one end of the first conveyance roller, the first drive motor, and the second drive motor;

a second frame that supports the other end of the first conveyance roller; and a plate disposed between the first drive motor and the second drive motor in the upper-lower direction and that connects the first frame and the second frame.

9. The sheet conveyance device according to claim 8, wherein the first frame has a recess recessed toward the second frame, and wherein at least a part of the first drive motor is located in the recess.

10. The sheet conveyance device according to claim 9, further comprising:

a support member that supports the first drive motor and covers the recess; and a cover disposed outside the support member and constituting an appearance of the sheet conveyance device.

11. The sheet conveyance device according to claim 6, further comprising:

a fourth conveyance roller disposed closer to the branch position than the third conveyance roller in the fourth conveyance path and configured to convey the sheet;

a fifth conveyance roller that forms a nip with the fourth conveyance roller; and a sixth conveyance roller that forms a nip with the first conveyance roller, wherein the third belt is configured to transmit the driving force from the second drive motor to the third conveyance roller and the fourth conveyance roller, and wherein a roller pair constituted by the fourth conveyance roller and the fifth conveyance roller and a roller pair constituted by the first conveyance roller and the sixth conveyance roller partially overlap each other as viewed in the upper-lower direction.

12. The sheet conveyance device according to claim 11, wherein the first belt and the fourth conveyance roller overlap each other as viewed in the axial direction of the first drive motor.

13. The sheet conveyance device according to claim 11, wherein the first conveyance roller is disposed above the fourth conveyance roller.

14. An image forming device comprising:

the sheet conveyance device according to claim 1; and an image forming unit configured to form an image on the sheet to be conveyed.

15. The image forming device according to claim 14, further comprising:

a first frame provided in the main body;

a second frame provided in the main body and that faces the first frame;

a first plate provided in an upper portion of the main body and that connects the first frame and the second frame;

a drawer configured to support a photosensitive drum and fixed to the first frame below the first plate; and a third drive motor supported by the first frame and configured to be located above the photosensitive drum, wherein the first plate is fixed to the first frame at a plurality of plate fixing points, wherein the drawer is fixed to the first frame at a plurality of drawer fixing points, and wherein, as viewed from a first direction in which the first frame and the second frame face each other, at least a part of the first drive motor is located in a region of the first frame where the plate fixing points and the drawer fixing points serve as vertices.

16. The image forming device according to claim 15, wherein a rotation axis of the first drive motor is located in the region as viewed in the first direction.

17. The image forming device according to claim 15, further comprising:

a second plate located below the drawer and that connects the first frame and the second frame; and a fourth drive motor supported by the first frame and configured to drive the photosensitive drum, wherein at least a part of the fourth drive motor overlaps the second plate as viewed in the first direction.

18. The image forming device according to claim 15, further comprising:

a fixing unit configured to fix a toner image formed on the sheet;

a fifth drive motor supported by the first frame and configured to drive the fixing unit; and a metal plate to which the third drive motor, the fourth drive motor, and the fifth drive motor are attached, wherein the metal plate is attached to the first frame.

19. The image forming device according to claim 15, wherein one of the first frame and the drawer includes an engaging portion, wherein the other of the first frame and the drawer includes an engaged portion to be engaged with the engaging portion, and wherein by engaging the engaging portion with the engaged portion, the drawer is fixed to the first frame in a state where the drawer is positioned in the first direction.

20. A sheet conveyance device comprising:

a first conveyance path configured to allow a sheet to be conveyed along the first conveyance path;

a second conveyance path that extends upward from a branch position in the first conveyance path, the second conveyance path being configured to allow the sheet that has passed through the first conveyance path to be conveyed along the second conveyance path;

a third conveyance path that extends downward from the branch position, the third conveyance path being configured to allow the sheet that has passed through the second conveyance path to be conveyed along the third conveyance path;

a first conveyance roller disposed in the second conveyance path and configured to rotate normally and reversely to convey the sheet;

a first drive motor disposed below the branch position;

a first belt disposed in a drive transmission path from the first drive motor to the first conveyance roller and configured to transmit a driving force from the first drive motor to the first conveyance roller;

a second conveyance roller disposed in the third conveyance path and configured to convey the sheet; and a second belt disposed in a drive transmission path from the first drive motor to the second conveyance roller and configured to transmit the driving force from the first drive motor to the second conveyance roller.

* * * * *